US007221343B2

(12) United States Patent
Kageyama et al.

(10) Patent No.: US 7,221,343 B2
(45) Date of Patent: May 22, 2007

(54) IMAGE DISPLAY APPARATUS

(75) Inventors: Hiroshi Kageyama, Hachioji (JP); Hajime Akimoto, Ome (JP)

(73) Assignee: Hitachi, Ltd., Tokyo (JP)

( * ) Notice: Subject to any disclaimer, the term of this patent is extended or adjusted under 35 U.S.C. 154(b) by 259 days.

(21) Appl. No.: 10/438,838

(22) Filed: May 16, 2003

(65) Prior Publication Data

US 2003/0214469 A1 Nov. 20, 2003

(30) Foreign Application Priority Data

May 17, 2002 (JP) ..... P2002-142365

(51) Int. Cl.
*G09G 3/32* (2006.01)

(52) U.S. Cl. ..... 345/82; 345/83

(58) Field of Classification Search ..... 345/82–102, 345/60, 63, 690, 147–149, 100, 182, 183, 345/204, 55, 156, 178, 179; 348/207, 222; 358/296; 315/291, 185
See application file for complete search history.

(56) References Cited

U.S. PATENT DOCUMENTS 5,019,917 A * 5/1991 Hata et al. ..... 358/448
5,283,658 A * 2/1994 Hayashi et al. ..... 358/296
6,144,366 A * 11/2000 Numazaki et al. ..... 345/156
6,323,880 B1 * 11/2001 Yamada ..... 345/690
6,400,101 B1 * 6/2002 Biebl et al. ..... 315/291
6,744,426 B1 * 6/2004 Okamoto et al. ..... 345/179
6,784,876 B1 * 8/2004 Nagai et al. ..... 345/178
6,909,419 B2 * 6/2005 Zavracky et al. ..... 345/102
2002/0047826 A1 * 4/2002 Akimoto et al. ..... 345/100
2002/0158823 A1 * 10/2002 Zavracky et al. ..... 345/87
2003/0016191 A1 * 1/2003 Nakamura et al. ..... 345/55
2003/0030629 A1 * 2/2003 Tam et al. ..... 345/204
2003/0214522 A1 * 11/2003 Kageyama et al. ..... 345/690
2004/0004591 A1 * 1/2004 Akimoto et al. ..... 345/84
2004/0066363 A1 * 4/2004 Yamano et al. ..... 345/98
2004/0179003 A1 * 9/2004 Jang ..... 345/204
2005/0264474 A1 * 12/2005 Rast ..... 345/55

* cited by examiner

*Primary Examiner*—Bipin Shalwala
*Assistant Examiner*—Prabodh Dharia
(74) *Attorney, Agent, or Firm*—Antonelli, Terry, Stout & Kraus, LLP.

(57) ABSTRACT

There is provided an image display apparatus having light emitting elements in its pixels, producing high resolution, facilitating γ correction, and free from occurrence of pseudo contours. A pixel circuit of the image display apparatus of the present invention with a switch circuit for switching between two states of supply and cutoff of a current to the light emitting element, a preset circuit for presetting the switch circuit at one of the two states independently of an analog display voltage signal, and a reset circuit for reversing the one of the two states of the switch circuit based upon the analog display voltage signal.

15 Claims, 13 Drawing Sheets

IMAGE DISPLAY APPARATUS

BACKGROUND OF THE INVENTION

1. Technical Field of the Invention

The present invention relates to an image display apparatus, and particularly to an image display apparatus having a light emitting element in each of its pixels.

2. Prior Art

Among the image display apparatuses employing a light emitting element in each of its pixels, many reports have been made on EL displays using electroluminescent (hereinafter abbreviated as EL) elements.

In the active matrix type EL display, wiring lines for transmitting signals and currents are arranged in a matrix configuration, and a pixel circuit formed of thin film transistors (hereinafter abbreviated as TFTs), which are active elements, is incorporated in addition to the EL element within each of its pixels.

As methods for the pixel circuit to control light intensity of the EL element, there is a method by modulating a duration of time during which a pixel circuit supplies a current to an EL element, as reported in SID '00 DIGEST, PP. 924–927, FIGS. 1, 2 and 6.

FIG. 15 illustrates a conventional pixel using an EL element. A pixel 151 is composed of a pixel circuit and an EL element 156. The pixel circuit is composed of TFT 152–TFT 154 and a capacitor 155.

Connected to the pixel 151 are a signal line Dline for inputting a digital signal which is a display signal, a line Vline for supplying a current to the EL element 156, a signal line PS for supplying a signal for writing the display signal on the signal line Dline into the capacitor 155, and a signal line ES for supplying a signal for resetting the capacitor 155.

The pixel 151 can produce many gray scale levels of luminance by the following drive method.

In a case where luminance is generated which is represented by a 6-bit gray scale including 64 gray scale levels, for example, one frame period used for displaying one picture is divided into six sub-frame periods, and the following operation is performed during each of the six sub-frame periods.

At the beginning of one sub-frame period, a digital voltage signal bx, which is a display signal, is supplied to the signal line D1, and an H level pulse is supplied to the signal line PS, and thereby TFT 152 is turned ON, and the digital voltage signal bx is stored in the capacitor 155.

The capacitor 155 retains the digital voltage signal bx during the sub-frame period, and if the voltage bx is at the L level, since TFT 154 is ON, the EL element 156 is lighted, and if the voltage bx is at the H level, since TFT 154 is OFF, the EL element 156 is extinguished.

After a specified lighting time, the H level pulse is supplied to the signal line ES, TFT 153 is turned ON, thereby the capacitor 155 is reset, and TFT 154 is turned OFF. If the ratio between the specified lighting times of the six sub-frames are selected to be 32:16:8:4:2:1, and voltages corresponding to respective digital bits of the display data are supplied in the order beginning with the MSB (Most Significant Bit) as the digital voltage signals bx, average luminance of a pixel averaged over one frame period is proportional to the display data. Here, the H and L levels mean the binary voltages of the digital voltage signals.

The pixels 151 are arranged in two dimensions, and an image is displayed by writing display signals successively into the pixels.

The method of controlling the average luminance by varying the duration of the lighting time of the EL element in this way has an advantage that it is easy to produce multi-gray scale display good in linearity, because a current flowing through the EL element 156 does not depend upon display signals, and therefore the EL display can display an image whose brightness varies smoothly.

SUMMARY OF THE INVENTION

PROBLEMS TO BE SOLVED BY THE INVENTION

In a case where display signal is written with one frame period being divided into a plurality of sub-frames as explained in connection with FIG. 15, the number of times when display signals into each of the pixels increases. For example, in a cases where a six-bit-represented (64 gray-scale-level) image and an eight-bit-represented (256 gray-scale-level) image are displayed, it is necessary to write display signals six and eight times, respectively. The time for writing the display signals into the pixels is shortened in inverse proportion to the number of writing. Consequently, in the case of a high-resolution display having a large number of pixels, since time for writing is limited, it is impossible to write display signals plural times within one frame period.

Further, it is reported that, if lighting times are plural in number within one frame period, noise called a pseudo contour or a false pixel appears when the eye follow a moving object.

Further, since the lighting time is divided based upon relative weights of the respective digital bits, basically the average luminance of the pixel is proportional to the display data, and therefore, γ correction requires the number of sub-frames larger than the number of digital bits for an image, and it is very difficult to perform γ correction.

The present invention reduces the number of times of writing into each of the pixels within one frame period, and thereby facilitates increasing of resolution. Lighting time is one within one frame period, and therefore pseudo contour does not occur, and γ correction is easily realized.

MEANS FOR SOLVING THE PROBLEMS

A pixel circuit in an image display apparatus is provided with switching means for controlling a current to a light emitting element by switching between two states of supply and cutoff of the current, preset means for preset said switching means at one of said two states independently of an analog voltage signal which is a display signal, and reset means for reversing states of the switching means based upon the analog voltage signal which is the display signal.

BRIEF DESCRIPTION OF THE DRAWINGS

DETAILED DESCRIPTION OF THE PREFERRED EMBODIMENTS (1) FIG. 1 is a circuit diagram illustrating pixels and their peripheries in a first embodiment in accordance with the present invention. A plurality of pixels 12 are arranged in two dimensions in a display region 11 for displaying an image. The pixel 12 is composed of a pixel circuit formed of TFT 13–TFT 16 and capacitors 17, 18, and an EL element 21. A cathode of the EL element 21 is connected to a common electrode 29. All of TFT 13–TFT 16 are n-channel type thin film transistors. Arranged in a matrix configuration in the display region 11 are signal lines D1, D2 for transmitting analog voltage signals containing display signals, lines E1, E2 for supplying a current to be flowed into the EL element 21, and signal lines W1, W2, P1, and P2 for controlling the pixel circuit of the pixel 12. One terminal of the capacitor 18 is connected to an electrode 19. The electrode 19 is formed by a line grounded outside of the pixel circuit, is connected to the common electrode 29, or is connected to the line E1.

TFT 16 serves as switching means, and controls the supply and cutoff of a current from the line E1 to the EL element 21. The capacitor 18 stores an ON or OFF state of TFT 16 serving as switching means by retaining a gate voltage of TFT 16. TFT 15 serves as preset means, and presets a voltage at the capacitor 18 when a positive pulse is input to the signal line P1. TFT 14 serves as reset means, and controls resetting of the voltage of the capacitor 18 depending upon whether the gate voltage of TFT 14 exceeds its threshold voltage or not. TFT 13 serves as means for canceling the threshold voltage of TFT 14. The capacitor 17 is storage means for storing a voltage difference between an analog display voltage signal on the signal line D1 and the threshold voltage of TFT 14.

Figure 2:
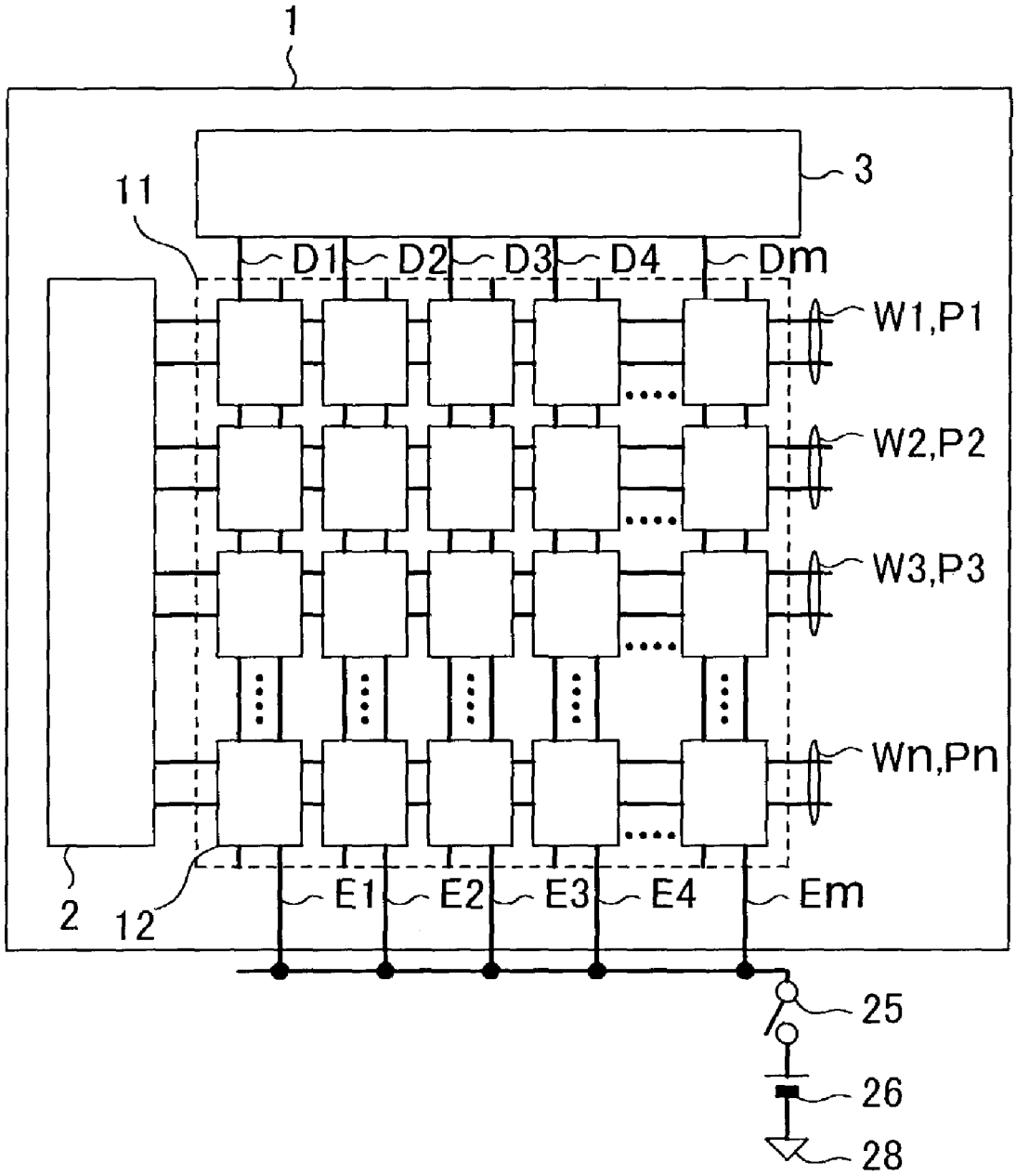
FIG. 2 is an illustration of a configuration of first and second embodiments in accordance with the present invention.

FIG. 2 illustrates a configuration of the first embodiment and a second embodiment in accordance with the present invention. The display region 11 is disposed on a surface of a glass substrate 1, and a plurality of pixels 12 are fabricated in the display region 11.

In the first embodiment of the present invention, disposed on the surface of the glass substrate 1 are the signal lines W1–Wn, P1–Pn, and D1–Dm, lines E1–Em, a scanning circuit 2 for generating control signals for the signal lines W1–Wn, and P1–Pn, and a signal circuit 3 for generating signals for the signal lines D1–Dm. The scanning circuit 2 and the signal circuit 3 can be formed by fabricating thin film transistors on the glass substrate 1, or can be formed by attaching semiconductor LSIs on the glass substrate 1. Capability of the scanning circuit 2 for supplying signals to the signal lines W1–Wn and P1–Pn is improved by arranging the scanning circuits 2 on opposite sides of the display region 11. The signal circuit 3 may be disposed either above or below the display region 11 in FIG. 2.

A power supply 26 external to the glass substrate 1 is connected to a grounding electrode 28 and all of the lines E1–Em. The lines E1–Em are connected together with each other on the surface of the glass substrate 1 or outside of the glass substrate 1. When the lines E1–Em are connected together on the surface of the glass substrate 1, they may be formed as a single mesh-like electrode by forming many lines short-circuiting adjacent ones of the lines E1–Em.

A switch 25 is provided between the power supply 26 and the lines E1–Em, and controls the supply of a current from the power supply 26. Therefore, the switch 25 may be provided between the power supply 26 and the grounding electrode 28. Further, plural switches 25 each formed of a TFT may be provided in parallel with each other between the respective ones of the pixels 12 and the lines E1–Em.

Although not shown in FIG. 2, the common electrode 29 is formed to cover the display region 11, and is connected to the EL elements 21 of all the pixels 12. The common electrode 29 is electrically connected to the grounding electrode 28.

Light emitted from the EL element 21 of the pixel 12 passes through the glass substrate 1 toward its rear surface, and a display image is viewed from the reverse side of paper of FIG. 2. If the common electrode 29 is made of transparent material, the display image can also be viewed from the front side of FIG. 2. An organic EL diode can be used as the EL element 21. If red, green, and blue light emitting materials are used for corresponding ones of the EL elements 21, a color display can be produced.

Figure 1:
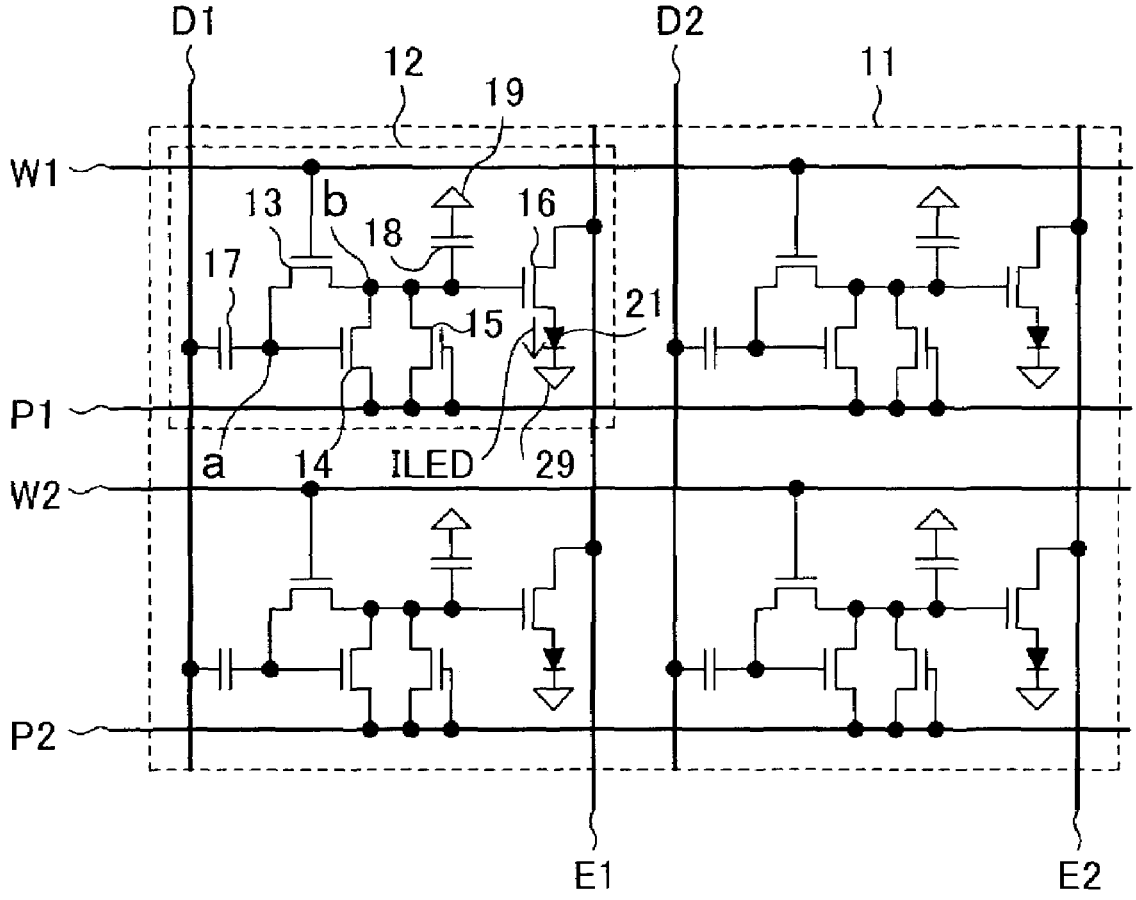
FIG. 1 is a circuit diagram illustrating pixels and their peripheries in a first embodiment in accordance with the present invention.

Incidentally, the display region 11 is illustrated as formed of only four (2×2) pixels 12 in FIG. 1, but the display region 11 intended for practical use has a larger number of pixels. In the case of resolution of color VGA (640 pixels×3 colors (red, green and blue)×480 pixels), the number m of pixels arranged in a horizontal direction in FIG. 2=1,920, and the number n of pixels arranged in a vertical direction in FIG. 2=480. The numbers of the signal lines D1–Dm and the lines E1–Em are 1,920, respectively. The numbers of the signal lines W1–Wn and P1–Pn are 480, respectively.

Figure 3A:
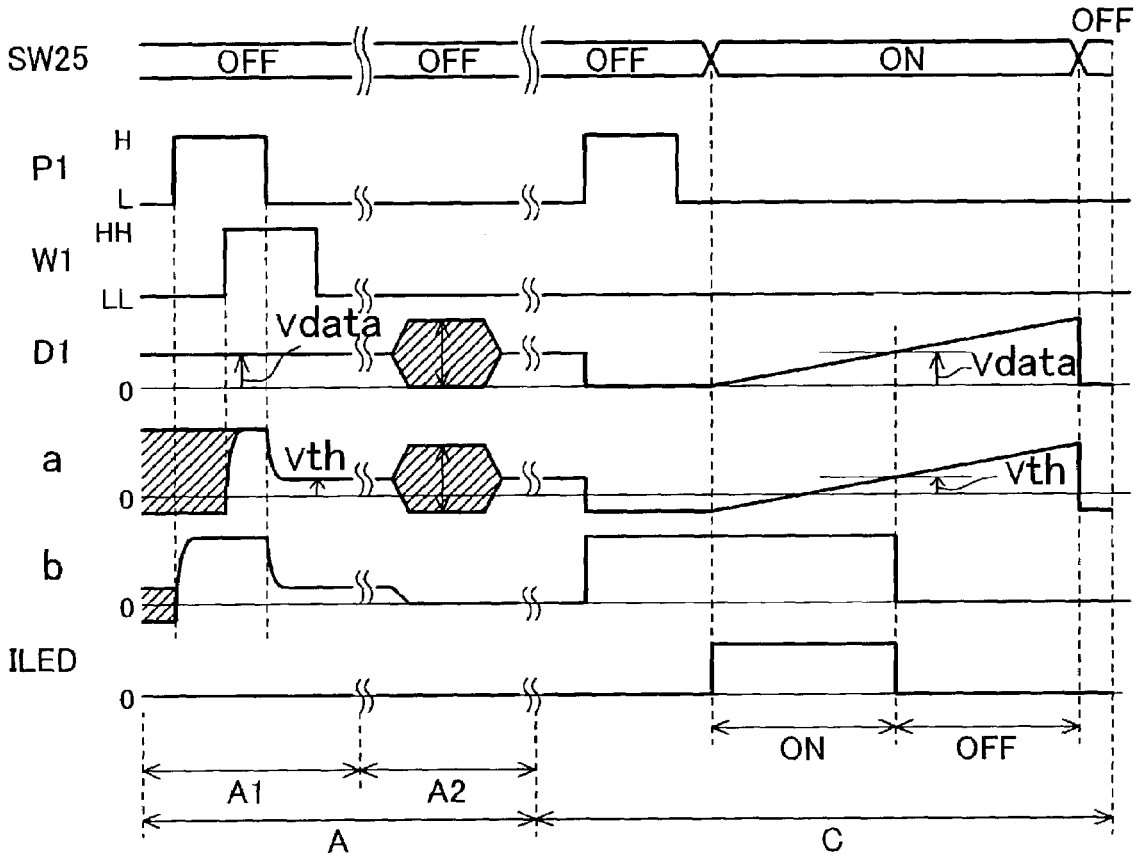
FIG. 3 illustrates a drive voltage waveform, an operating voltage waveform, an operating current waveform, and their timing charts in the first embodiment in accordance with the present invention.
Figure 3B:
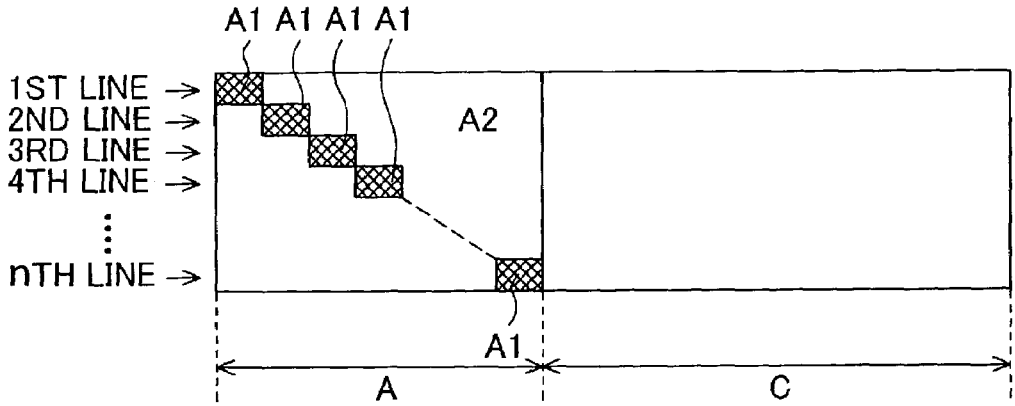

FIG. 3A illustrates a drive voltage waveform, an operating voltage waveform, and an operating current waveform in the first embodiment in accordance with the present invention, and FIG. 3B is a timing chart of the waveforms of FIG. 3A during one frame period.

The abscissa of FIG. 3A represents time, and portions indicated by wavy lines mean there is discontinuity in time.

In FIG. 3A, SW25 represents states of the ON and OFF operation of the switch 25, W1, P1 and D1 represent voltages supplied to their corresponding lines on corresponding ones of the ordinates, and "a" and "b" represent voltages appearing at nodes a and b in FIG. 1 on the respective ordinates. ILED indicates a current flowing into the EL element 21 on the ordinate. In FIG. 3A, the more positive values are nearer the top of FIG. 3A. The signals of W1 and P1 are binary logical voltages, and the signal of D1 is an analog signal voltage.

In W1, the HH level is a voltage at which TFT 13 is turned ON, and the LL level is a voltage at which TFT 13 is turned OFF. In P1, the H level is a voltage sufficient for turning TFT 16 ON, and the L level is a voltage sufficient for turning TFT 16 OFF.

Analog voltages on the signal line D1 and at the nodes a, b are illustrated with the reference voltage 0 volt taken as the L level voltage. Hatched portions in FIG. 3A indicate they can take plural values, or they are not relevant to operations.

A suffix "1" in W1, P1 and D1 in FIG. 3A indicates that they are signals supplied to the pixel 12 in the first column and the first row, and therefore voltages W, P and D for other pixels are followed by numerals indicating rows or columns associated with them.

In the timing chart in FIG. 3B, the ordinate represents line numbers in the display region 11, "mth" indicating that a given pixel 12 is in the mth line from the top of the display region 11, and the abscissa represents time in one frame period.

One frame period is divided into a time A for writing display signals into-pixels and a time C for the EL elements to emit light and thereby to display an image. Further, the time A is divided into times A1 each of which is used for writing display signals into pixels in a given line and times A2 each of which is used for writing display signals into pixels in lines other than the given line.

During the time A, the times A1 are assigned to successive time positions of the first (at the beginning of the time A), second, third, . . . , nth lines (at the end of the time A), respectively, and the rest of the time A after the times A1 are the times A2.

The switch 25 is OFF during the time A, no current flows through the EL element 21 regardless of whether TFT 16 is in the ON or OFF state, and therefore the EL elements are not lit.

During the time A1, when the analog display voltage signal Vdata is supplied to the signal line D1, it is also supplied to one terminal of the capacitor 17 connected to the signal line D1. Initially, when the signal line P1 is changed to the H level, the H level voltage is supplied to the node b via TFT 15. Then, when the signal line W1 is changed to the HH level, TFT 13 is turned ON, and thereby the node a changes to the H level. Thereafter, when the signal line P1 is changed to the L level, a current flows through TFT 14, there remains at the nodes a and b, a threshold voltage Vth which is a voltage between the gate and source electrodes of TFT 14 just enough to switch between ON and OFF states between the drain and source electrodes of TFT 14, and therefore the threshold voltage Vth is applied to the other terminal of the capacitor 17. Finally, when the signal line W1 is changed to the LL level, the node a is disconnected from the node b, and thereby the capacitor 17 stores the voltage difference (Vdata−Vth), where Vdata is the analog display voltage signal, and Vth is the threshold voltage of TFT 14.

During the time A2, since display signals are being written into the pixels in the lines other than the given line, the signals on the signal lines W1 and P1 are unchanged. At this time, although the voltage on the signal line D1 changes, TFT 14 is in the OFF state, and therefore the voltage (Vdata−Vth) stored in the capacitor 17 is retained.

During the time C, the pixel 12 is lit. At the beginning of the time C, the signal line P1 is supplied with the H level pulse, which is applied to the capacitor 18 via TFT 15, and TFT 16 is turned ON. Even after the signal line P1 has changed to the L level, since the capacitor 18 stores the H level voltage, TFT 16 retains its ON state. Here the pulse is supplied to all the signal lines P1–Pm, and thereby all the pixels perform the same operation (the preset operation).

Then, TFT 16 is supplied with a current from the power supply 26 by turning ON the switch 25. Since the H level voltage is stored in the capacitor 18, TFT 16 is in the ON state, and therefore the EL element 21 is supplied with the current, and thereby it emits light.

On the other hand, the signal line D1 is supplied with a triangular waveform voltage increasing uniformly from the lowest voltage to the highest voltage of a range where analog voltages of display signals can take. During the time C, the voltage on the signal line D1 increases gradually with time in a triangular waveform fashion, and therefore the voltage at the node a in the pixel 12 also increases. When the voltage on the signal line D1 becomes equal to the voltage Vdata having been written into each of the pixels 12 during the time A1, the voltage at the node a becomes just equal to the threshold voltage Vth of TFT 14, and thereby TFT 14 changes from OFF to ON, the charge in the capacitor 18 is discharged through TFT 14, and the voltage at the node b changes to the L level. As a result, TFT 16 is turned OFF, the current flowing through TFT 16 becomes zero, and the EL element 21 ceases to emit light (reset operation).

It is necessary to fix the signal line P1 at the L level when the triangular waveform voltage is supplied to the signal line D1, because the threshold voltage Vth of TFT 14 is a voltage with respect to a voltage of its source electrode. That is to say, the L level voltage of the signal line P1 serves as the reference voltage for the triangular waveform voltage.

Finally, the time C is terminated by turning OFF the switch 25 again.

As explained above, the preset operation of turning ON TFT 16 in the time C is performed at the beginning of the time C regardless of display signals, and timing of the reset operation of turning OFF TFT 16 depends upon the analog display signal voltage Vdata. Therefore the ratio in duration between the ON time and the OFF time of the EL element 21 can be varied from 0% to 100% of the ON time of the switch 25 based upon the analog voltage Vdata.

By supplying a current from the power supply 26 such that the luminance of light emission from the EL element 21 is approximately constant in the light-emitting state of the EL element 21, the average luminance of the EL element 21 can be controlled by this ratio between the ON time and the OFF time, that is, the analog display signal voltage Vdata.

The average luminance of each of the pixels can be controlled to produce various levels according to the analog display voltage signals Vdata, and consequently, the first embodiment of the present invention is capable of producing an image containing various gray scale levels.

Further, γ correction can be easily made on a relationship between the analog voltage signals Vdata and the average luminance only by varying the angle of slope of the triangular waveform voltage to be supplied to the signal line D1. Further, a voltage of a waveform increasing with time discontinuously can be used instead of the voltage of a triangular waveform illustrated in FIG. 3A. For example, a voltage of a waveform can be used which increases with time in a staircase fashion.

Further, the light emitting time of the EL element 21 is always continuous within one frame time, and therefore no pseudo contours appear even when moving pictures are displayed. The number of times when display signals are written into each of the pixels 12 during one frame period is only once, therefore the number of writing times is small, and increasing of resolution is facilitated.

Consequently, the first embodiment of the present invention is capable of providing the EL display which is easy to achieve γ correction, free from occurrence of pseudo contours in moving pictures, and easy to increase resolution.

As a first modification of the first embodiment of the present invention, TFT 16 can be formed of a p-channel type thin film transistor. In this case, TFT 16 is OFF when its gate voltage is at the H level, and TFT 16 is ON when its gate voltage is at the L level. Therefore TFT 16 is turned OFF by the preset operation during the time C, and the state of TFT 16 is inverted into the ON state by the reset operation. That is to say, the lighting time and extinguishing time of the EL element 12 during the time C are interchanged. In this modification also, the average luminance of the EL element 21 can be controlled by this ratio between the ON time and the OFF time, that is, the analog display signal voltage Vdata, and therefore this modification provides the same advantages as in the case of the first embodiment.

Figure 4:
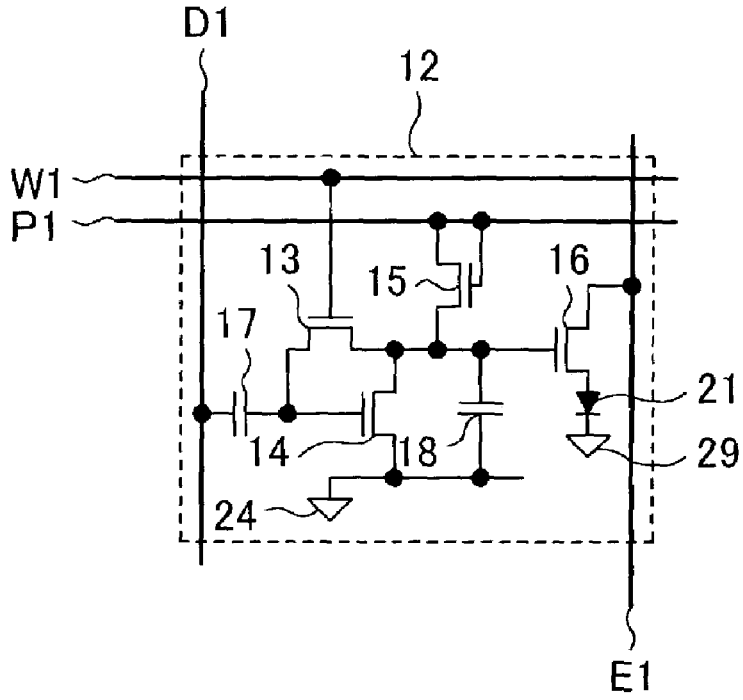
FIG. 4 is a circuit diagram illustrating a pixel in a second modification of the first embodiment in accordance with the present invention.

As a second modification of the first embodiment of the present invention, a line for supplying the H pulse to start the preset operation and a line for supplying a voltage serving as a reference for the triangular waveform are provided separately from each other. FIG. 4 illustrates a pixel circuit in the second modification of the first embodiment of the present invention. TFT 13–TFT 16, the capacitors 17, 18 and the EL element 21 forming the pixel 12 are identical with those in FIG. 1, the configuration of FIG. 4 differs from that of FIG. 1, in that the source electrode of TFT 14 and one terminal of the capacitor 18 are connected to an electrode 24. The electrode 14 is formed of a line connecting plural pixels 12, and is externally supplied with a voltage serving as a reference for the triangular waveform voltage supplied to the signal line D1. This second modification of the first embodiment of the present invention can operate with waveforms identical to those in FIG. 3, and is capable of providing the same advantages as in the case of the first embodiment.

Figure 5:
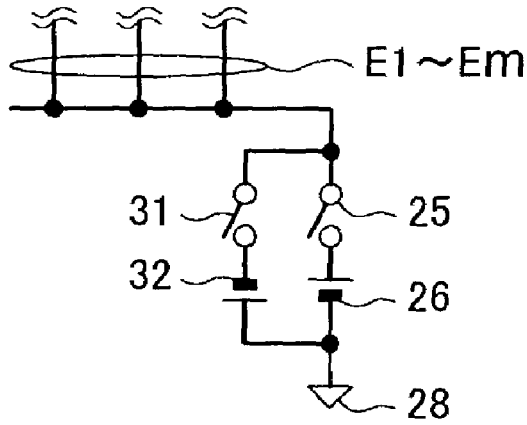
FIG. 5 illustrates features of a third modification of the first embodiment in accordance with the present invention.

As a third modification of the first embodiment of the present invention, as shown in FIG. 5, a circuit composed of a power supply 32 and a switch 31 can be added as a load in parallel with a series combination of the power supply 26 and the switch 25 shown in FIG. 2, with the polarity of the power supply 32 opposite from that of the power supply 26. By turning ON the switch 31 during a time when the switch 25 is OFF, it is possible to remove charge remaining in the EL element 21.

As a fourth modification of the first embodiment of the present invention, the EL element can be lit by reversing the connections of the anode and the cathode of the EL element, and thereby flowing the current ILED in the reverse direction. In this case, a current flowing in the reverse direction is supplied to the EL element by interchanging the positive and negative sides of the power supply 26.

Figure 6:
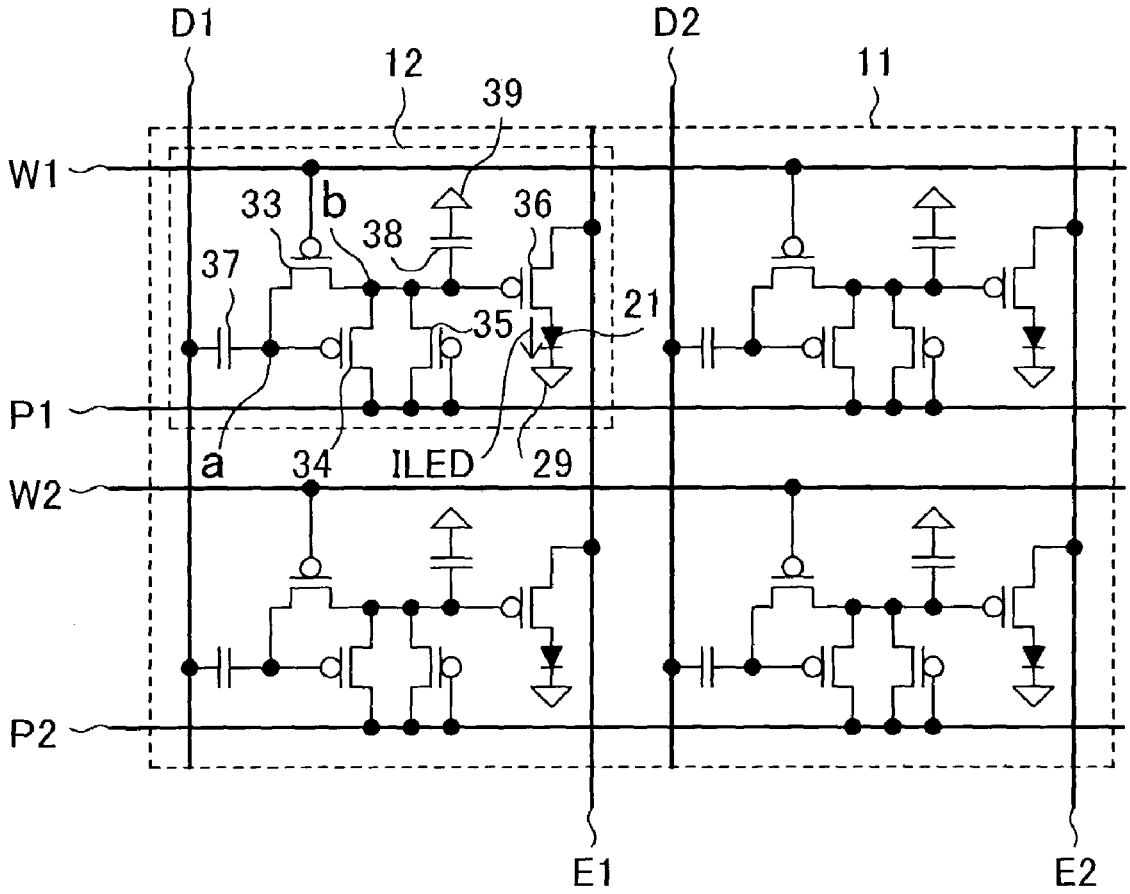
FIG. 6 is a circuit diagram illustrating pixels and their peripheries in a second embodiment in accordance with the present invention.

(2) FIG. 6 is a circuit diagram illustrating pixels and their peripheries in a second embodiment in accordance with the present invention. While the first embodiment of the present invention is formed basically of n-channel type thin film transistors, the second embodiment of the present invention is formed basically of p-channel type thin film transistors. A plurality of pixels 12 are arranged in two dimensions in a display region 11 for displaying an image. The pixel 12 is composed of a pixel circuit formed of TFT 33–TFT 36 and capacitors 37, 38, and an EL element 21. A cathode of the EL element 21 is connected to a common electrode 29.

All of TFT 33–TFT 36 are p-channel type thin film transistors. Arranged in a matrix configuration in the display region 11 are signal lines D1, D2 for transmitting analog voltage signals containing display signals, lines E1, E2 for supplying a current to be flowed through the EL element 21, and signal lines W1, W2, P1 and P2 for controlling the pixel circuit of the pixel 12. One terminal of the capacitor 38 is connected to an electrode 39. The electrode 39 is formed by a line grounded outside of the pixel circuit, is connected to the common electrode 29, or is connected to the line E1.

TFT 36 serves as switching means, and controls the supply and cutoff of a current from the line E1 to the EL element 21. The capacitor 38 stores an ON or OFF state of TFT 36 by retaining a gate voltage of TFT 36 serving as switching means. TFT 35 serves as preset means, and presets a voltage at the capacitor 38 when a negative pulse is input to the signal line P1. TFT 34 serves as reset means, controls resetting of the voltage of the capacitor 38 depending upon whether the gate voltage of TFT 34 exceeds its threshold voltage or not. TFT 33 serves as means for canceling the threshold voltage of TFT 34. The capacitor 37 is storage means for storing a voltage difference between an analog display voltage signal on the signal line D1 and the threshold voltage of TFT 34.

FIG. 2 illustrates a configuration of the first and second embodiment in accordance with the present invention. The second embodiment of the present invention differs in its internal structure of the pixel 12 from the first embodiment of the present invention, but the external structure of the second embodiment is identical to that of the first embodiment, and the explanation in connection with FIG. 2 for the second embodiment is identical to that in the case of the first embodiment, and therefore it is omitted here.

Incidentally, the display region 11 is illustrated as formed of only four (2×2) pixels 12 in FIG. 6, but the display region 11 intended for practical use has a larger number of pixels. In the case of resolution of color VGA (640 pixels×3 colors (red, green and blue)×480 pixels), the number m of pixels arranged in a horizontal direction in FIG. 6=1,920, and the number n of pixels arranged in a vertical direction in FIG. 6=480. The numbers of the signal lines D1–Dm and the lines E1–Em are 1,920, respectively. The numbers of the signal lines W1–Wn and P1–Pn are 480, respectively.

Figure 7A:
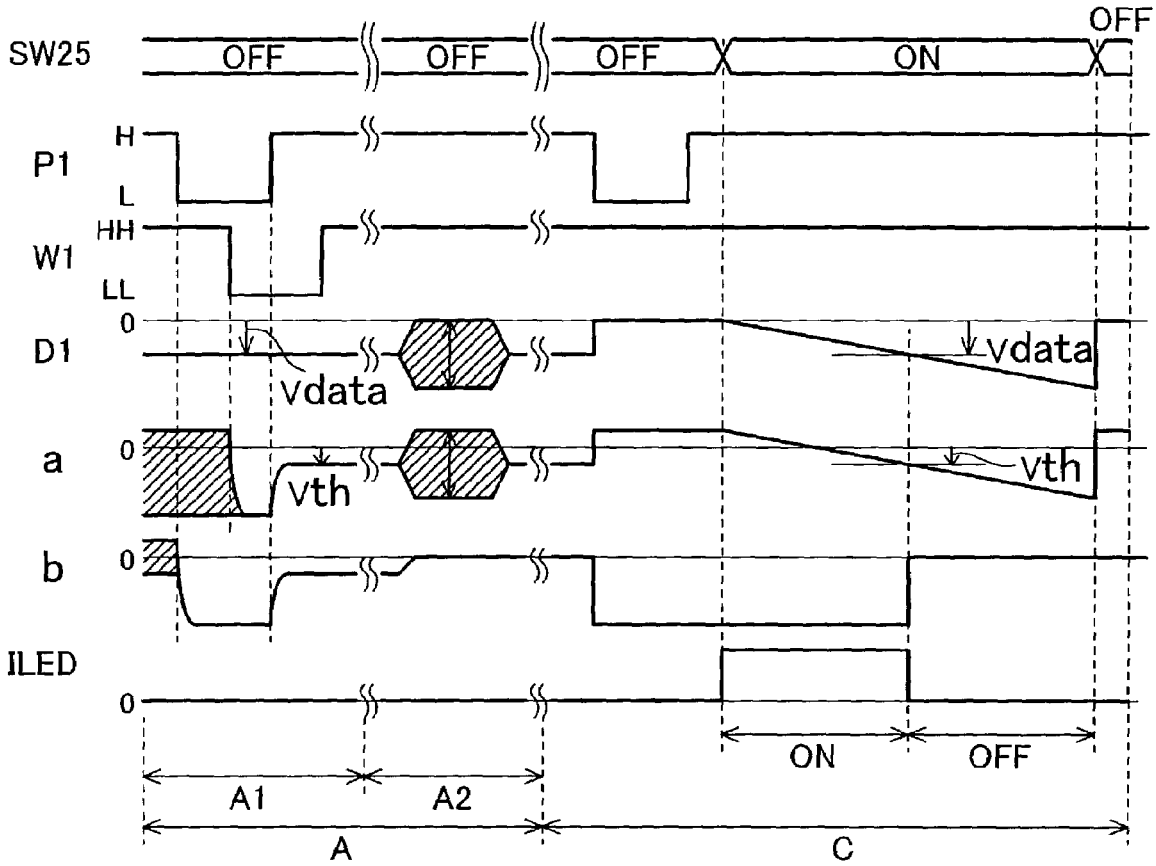
FIG. 7 illustrates a drive voltage waveform, an operating voltage waveform, an operating current waveform, and their timing charts in the second embodiment in accordance with the present invention.
Figure 7B:
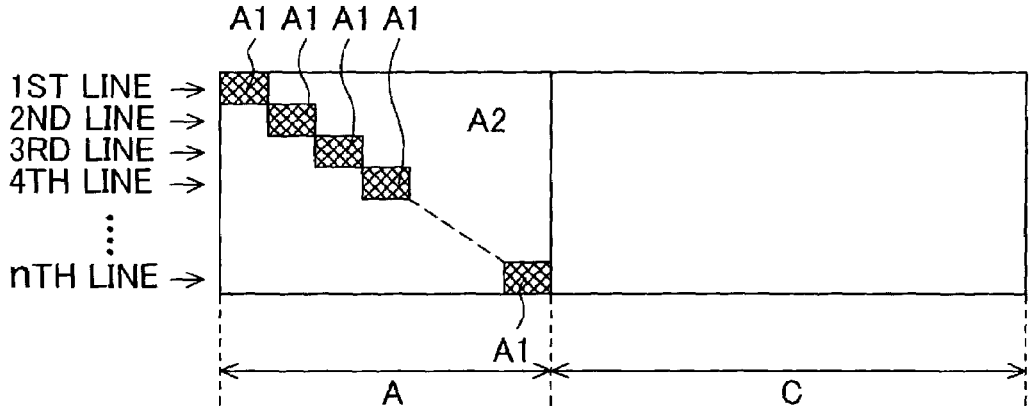

FIG. 7A illustrates a drive voltage waveform, an operating voltage waveform, and an operating current waveform in the second embodiment in accordance with the present invention, and FIG. 7B is a timing chart of the waveforms of FIG. 7A during one frame period.

The abscissa of FIG. 7A represents time, and portions indicated by wavy lines mean there is discontinuity in time.

In FIG. 7A, SW25 represents states of the ON and OFF operation of the switch 25, W1, P1 and D1 represent voltages supplied to their corresponding lines on corresponding ones of the ordinates, and "a" and "b" represent voltages appearing at nodes a and b in FIG. 6 on the respective ordinates. ILED indicates a current flowing into the EL element 21 on the ordinate. In FIG. 7A, the more positive values are nearer the top of FIG. 7A. The signals of W1 and P1 are binary logical voltages, and the signal of D1 is an analog signal voltage.

In W1, the LL level is a voltage at which TFT 33 is turned ON, and the HH level is a voltage at which TFT 33 is turned OFF. In P1, the L level is a voltage sufficient for turning ON TFT 36, and the H level is a voltage sufficient for turning OFF TFT 36.

Analog voltages on the signal line D1 and at the nodes a, b are illustrated with the reference voltage 0 volt taken as the H level voltage. Hatched portions in FIG. 7A indicate they can take plural values, or they are not relevant to operations.

A suffix "1" in W1, P1 and D1 in FIG. 7A indicates that they are signals supplied to the pixel 12 in the first column and the first row, and therefore voltages W, P and D for other pixels are followed by numerals indicating rows or columns associated with them.

In the timing chart in FIG. 7B, the ordinate represents line numbers in the display region 11, "mth" indicating that a given pixel 12 is in the mth line from the top of the display region 11, and the abscissa represents time in one frame period.

One frame period is divided into a time A for writing display signals into pixels and a time C for the EL elements to emit light and thereby to display an image. Further, the time A is divided into times A1 each of which is used for writing display signals into pixels in a given line and times A2 each of which is used for writing display signals into pixels in lines other than the given line.

During the time A, the times A1 are assigned to successive time positions of the first (at the beginning of the time A), second, third, . . . , nth lines (at the end of the time A), respectively, and the rest of the time A after the times A1 are the times A2.

The switch 25 is OFF during the time A, no current flows through the EL element 21 regardless of whether TFT 36 is in the ON or OFF state, and therefore the EL elements are not lit.

During the time A1, when the analog display voltage signal Vdata is supplied to the signal line D1, it is also supplied to one terminal of the capacitor 37 connected to the signal line D1. Initially, when the signal line P1 is changed to the L level, the L level voltage is supplied to the node b via TFT 35. Then, when the signal line W1 is changed to the LL level, TFT 33 is turned ON, and thereby the node a changes to the L level. Thereafter, when the signal line P1 is changed to the H level, a current flows through TFT 34, there remains at the nodes a and b, a threshold voltage Vth which is a voltage between the gate and source electrodes of TFT 14 just enough to switch between ON and OFF states between the drain and source electrodes of TFT 34, and therefore the threshold voltage Vth is applied to the other terminal of the capacitor 37. Finally, when the signal line W1 is changed to the HH level, the node a is disconnected from the node b, and thereby the capacitor 37 stores the voltage difference (Vdata−Vth), where Vdata is the analog display voltage signal, and Vth is the threshold voltage of TFT 34.

During the time A2, since display signals are being written into the pixels in the lines other than the given line, the signals on the signal lines W1 and P1 are unchanged. At this time, although the voltage on the signal line D1 changes, TFT 34 is in the OFF state, and therefore the voltage (Vdata−Vth) stored in the capacitor 37 is retained.

During the time C, the pixel 12 is lit. At the beginning of the time C, the signal line P1 is supplied with the L level pulse, which is applied to the capacitor 39 via TFT 35, and TFT 36 is turned ON. Even after the signal line P1 has changed to the H level, since the capacitor 39 stores the L level voltage, TFT 36 retains its ON state. Here the pulse is supplied to all the signal lines P1–Pm, and thereby all the pixels perform the same operation (the preset operation).

Then, TFT 36 is supplied with a current from the power supply 26 by turning ON the switch 25. Since the L level voltage is stored in the capacitor 38, TFT 36 is in the ON state, and therefore the EL element 21 is supplied with the current, and thereby it emits light.

On the other hand, the signal line D1 is supplied with a triangular waveform voltage decreasing uniformly from the highest voltage to the lowest voltage of a range where analog voltages of display signals can take. During the time C, the voltage on the signal line D1 decreases gradually with time in a triangular waveform fashion, and therefore the voltage at the node a in the pixel 12 also decreases. When the voltage on the signal line D1 becomes equal to the voltage Vdata having been written into each of the pixels 12 during the time A1, the voltage at the node a becomes just equal to the threshold voltage Vth of TFT 34, and thereby TFT 34 changes from OFF to ON, the charge in the capacitor 38 is discharged through TFT 34, and the voltage at the node b changes to the H level. As a result, TFT 36 is turned OFF, the current flowing through TFT 36 becomes zero, and the EL element 21 ceases to emit light (reset operation).

It is necessary to fix the signal line P1 at the H level when the triangular waveform voltage is supplied to the signal line D1, because the threshold voltage Vth of TFT 34 is a voltage with respect to a voltage of its source electrode. That is to say, the H level voltage of the signal line P1 serves as the reference voltage for the triangular waveform voltage.

Finally, the time C is terminated by turning OFF the switch 25 again.

As explained above, the preset operation of turning ON TFT 36 in the time C is performed at the beginning of the time C regardless of display signals, and timing of the reset operation of turning OFF TFT 36 depends upon the analog display signal voltage Vdata. Therefore the ratio in duration between the ON time and the OFF time of the EL element 21 can be varied from 0% to 100% of the ON time of the switch 25 based upon the analog voltage Vdata.

By supplying a current from the power supply 26 such that the luminance of light emission from the EL element 21 is approximately constant in the light-emitting state of the EL element 21, the average luminance of the EL element 21 can be controlled by this ratio between the ON time and the OFF time, that is, the analog display signal voltage Vdata.

The average luminance of each of the pixels can be controlled to produce various levels according to the analog display voltage signals Vdata, and consequently, the second embodiment of the present invention is capable of producing an image containing various gray scale levels.

Further, γ correction can be easily made on a relationship between the analog voltage signals Vdata and the average luminance only by varying the angle of slope of the triangular waveform voltage to be supplied to the signal line D1.

Further, the light emitting time of the EL element 21 is always continuous within one frame time, and therefore no pseudo contours appear even when moving pictures are displayed.

Further, the number of times when display signals are written into each of the pixels 12 during one frame period is only once, therefore the number of writing times is small, and increasing of resolution is facilitated.

Consequently, the second embodiment of the present invention is capable of providing the EL display which easily achieves γ correction, is free from occurrence of pseudo contours in moving pictures, and facilitates increasing of resolution.

As a first modification of the second embodiment of the present invention, TFT 36 can be formed of an n-channel type thin film transistor. In this case, TFT 36 is OFF when its gate voltage is at the L level, and TFT 36 is ON when its gate voltage is at the H level. Therefore TFT 36 is turned OFF by the preset operation during the time C, and the state of TFT 36 is inverted into the ON state by the reset operation. That is to say, the lighting time and extinguishing time of the EL element 12 during the time C are interchanged. In this modification also, the average luminance of the EL element 21 can be controlled by this ratio between the ON time and the OFF time, that is, the analog display signal voltage Vdata, and therefore this modification provides the same advantages as in the case of the second embodiment.

Further, the second embodiment of the present invention can employ a structure similar to that in each of the second, third and fourth embodiments of the first embodiment of the present invention.

Figure 8:
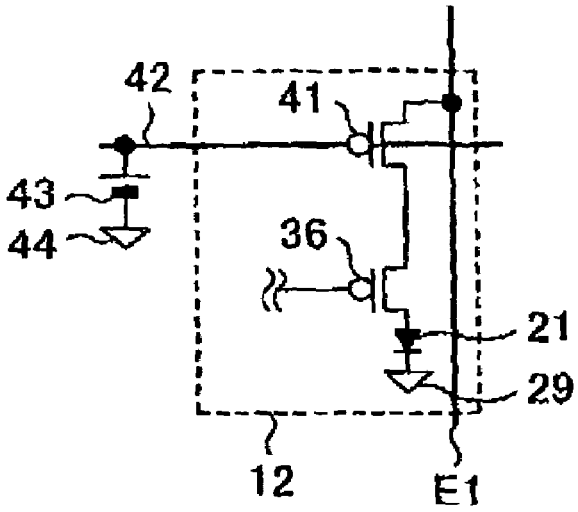
FIG. 8 illustrates features of a fifth modification of the first embodiment in accordance with the present invention.
Figure 15:
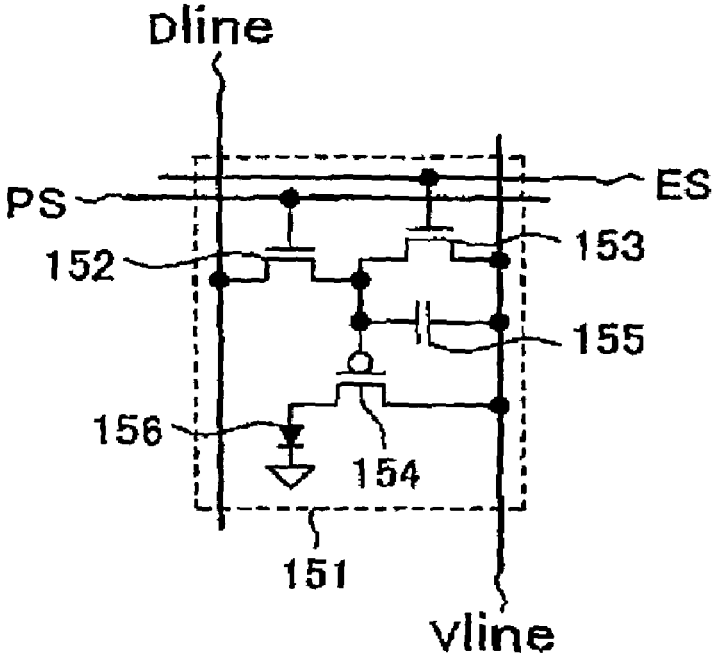
FIG. 15 (Prior Art)
FIG. 15 is an illustration of a configuration of a conventional pixel using an EL element.

As a fifth modification of the second embodiment of the present invention, as shown in FIG. 8, a p-channel type thin film transistor TFT 41 is can be inserted between the line E1 and TFT 36 which serves as switching means within the pixel 12. A gate electrode of TFT 41 is connected to one electrode of reference power supply 43 via a line 42 external to the display region 11, and the other electrode of the reference power supply 43 is connected to a grounding electrode 44. The grounding electrode 44 is connected to the common electrode 29, or the positive side of the power supply 26 shown in FIG. 2. The reference power supply 43 generates a gate voltage of TFT 41 such that TFT 41 operate in its saturation region and generates a constant current, and supplies the gate voltage to TFT 41 via the line 42.

With this configuration, a current flowing through the EL element 21 with TFT 36 being in the ON state becomes less susceptible to influences due to changes in voltage-current characteristics of the EL element 21, and stabler luminance can be produced.

Figure 9:
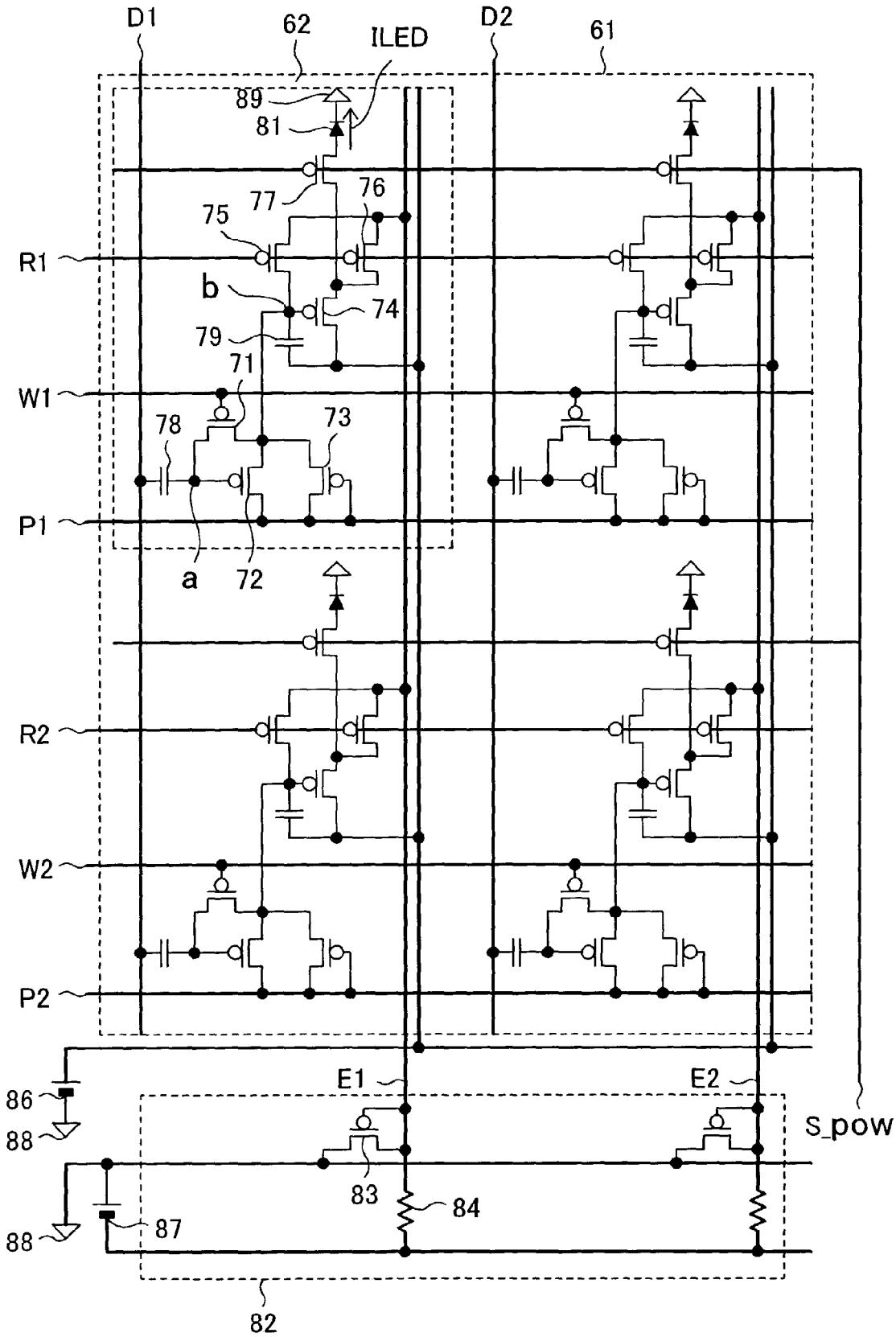
FIG. 9 is a circuit diagram illustrating pixels and their peripheries in a third embodiment in accordance with the present invention.

(3) FIG. 9 is a circuit diagram illustrating pixels and their peripheries in a third embodiment in accordance with the present invention. The third embodiment of the present invention is provided with a circuit for generating a constant current within a pixel for stabilizing a current flowing through an EL element when it is lit. A plurality of pixels 62 are arranged in two dimensions in a display region 61 for displaying an image. The pixel 62 is composed of a pixel circuit formed of TFT 71–TFT 77 and capacitors 78, 79, and an EL element 81. A cathode of the EL element 81 is connected to a common electrode 89. All of TFT 71–TFT 77 are p-channel type thin film transistors. Arranged in a matrix configuration in the display region 61 are signal lines D1, D2 for transmitting analog voltage signals containing display signals, lines E1, E2 for supplying a reference current, and signal lines W1, W2, P1, P2, R1 and R2 for controlling the pixel circuit of the pixel 62. Connected to all the pixels 62 are a power supply 86 for supplying a current to the EL element 81 and a signal line S_pow for controlling supply of the current to the EL element 21.

TFT 74 serves as switching means, and controls the supply and cutoff of the current from the line E1 to the EL element 81. The capacitor 79 stores an ON or OFF state of TFT 74 by retaining a gate voltage of TFT 74 serving as switching means. TFT 75 serves as preset means, and presets a voltage at the capacitor 79 when a negative pulse is input to the signal line R1.

TFT 72 serves as reset means, and controls resetting of the voltage of the capacitor 79 depending upon whether the gate voltage of TFT 72 exceeds its threshold voltage or not. TFT 71 serves as means for canceling the threshold voltage of TFT 72. The capacitor 78 is storage means for storing a voltage difference between an analog display voltage signal on the signal line D1 and the threshold voltage of TFT 72. Further, TFT 74–TFT 77 and the capacitor 79 form a constant-current circuit, and the capacitor 79 serves to store a gate voltage necessary for TFT 74 to generate a constant current when TFT 74 is in the ON state.

A reference-current source 82 is disposed outside of the display region 61, and is composed of a plurality of TFT-resistor combinations arranged laterally in FIG. 9. Each of the TFT-resistor combinations is formed of a resistor 84 for generating a constant current and TFT 83 serving as a protective diode for preventing a high voltage from appearing on the lines E1, E2. The reference-current source 22 is connected to a power supply 87 for generating the a reference current and the lines E1, E2 for supplying the constant current. The positive side of the power supply 87 is connected to a grounding electrode 88. The grounding electrode 88 and the common electrode 89 are electrically connected together.

TFT 83 is provided as a protective diode circuit for preventing a large negative voltage generated by the power supply 87 from appearing on the lines E1, E2.

Figure 10:
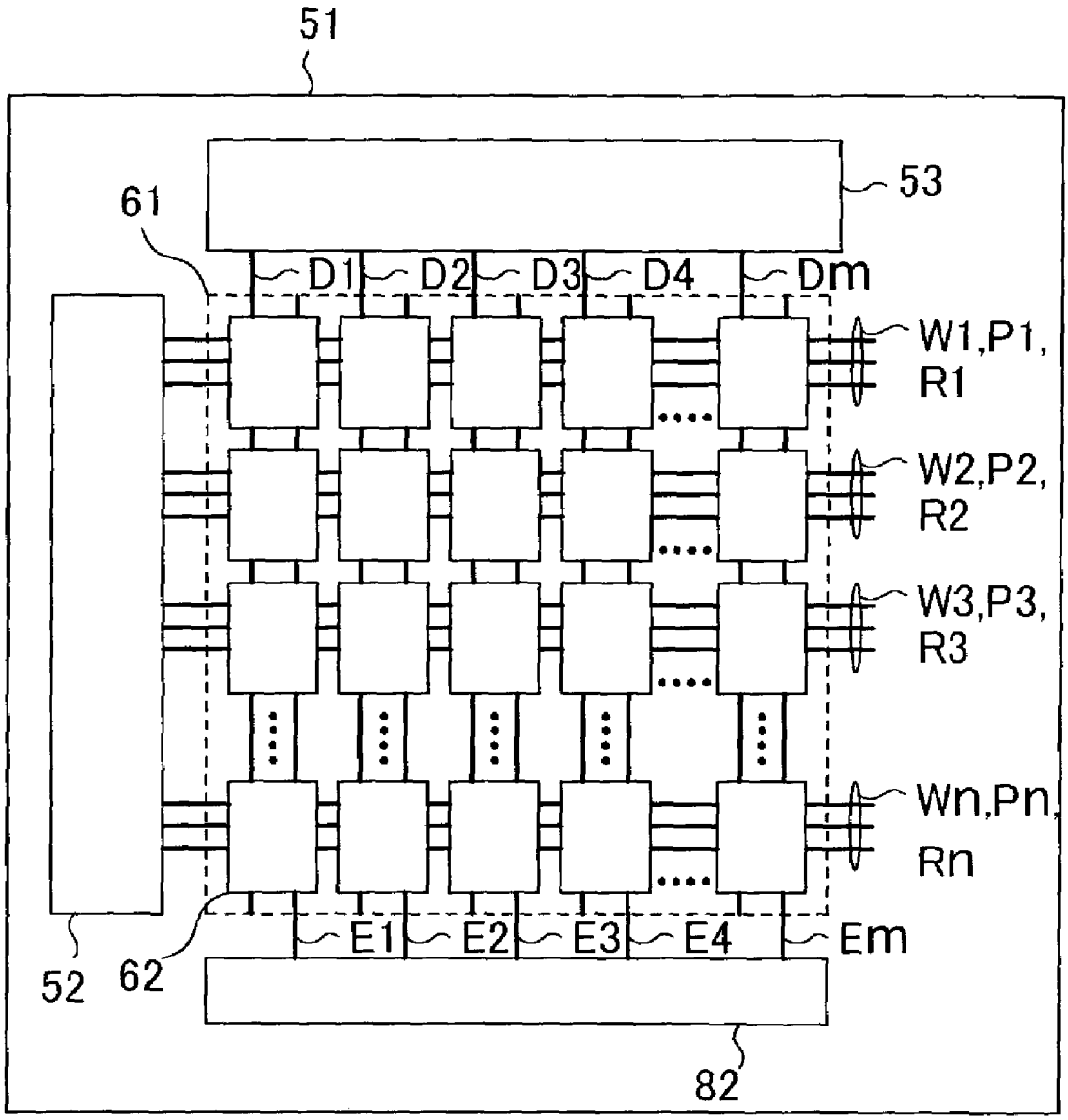
FIG. 10 is an illustration of a configuration of the third embodiment in accordance with the present invention.

FIG. 10 illustrates a configuration of the third embodiment in accordance with the present invention. The display region 51 is disposed on a surface of a glass substrate 51, and a plurality of pixels 62 are fabricated in the display region 51. Disposed on the surface of the glass substrate 51 are the signal lines W1–Wn, P1–Pn, R1–Rm, and D1–Dm, lines E1–Em, a scanning circuit 52 for generating control signals for the signal lines W1–Wn, P1–Pn and R1–Rn, a signal circuit 53 for generating signals for the signal lines D1–Dm, and a reference-current source 82 for generating a reference current for the lines E1–Em. The scanning circuit 52, the signal circuit 53, and the reference-current source 82 can be formed by fabricating thin film transistors on the glass substrate 51, or can be formed by attaching semiconductor LSIs on the glass substrate 51. Capability of the scanning circuit 2 for supplying signals to the signal lines P1–Pn, W1–Wn and R1–Rn is improved by arranging the scanning circuits 52 on opposite sides of the display region 61. The signal circuit 53 and the reference-current source 82 may be disposed either above or below the display region 61 in FIG. 10.

Although not shown in FIG. 10, the common electrode 89 is formed to cover the display region 61, and is connected to cathodes of the EL elements 81 of the pixels 62.

Light emitted from the EL element 81 of the pixel 62 passes through the glass substrate 51 toward its rear surface, and a display image is viewed from the reverse side of paper of FIG. 10. If the common electrode 89 is made of transparent material, the display image can also be viewed from the front side of FIG. 10. An organic EL diode can be used as the EL element 81. If red, green, and blue light emitting materials are used for corresponding ones of the EL elements 81, a color display can be produced.

Incidentally, the display region 61 is illustrated as formed of only four (2×2) pixels 62 in FIG. 9, but the display region 61 intended for practical use has a larger number of pixels. In the case of resolution of color VGA (640 pixels×3 colors (red, green and blue)×480 pixels), the number m of pixels arranged in a horizontal direction in FIG. 10=1,920, and the number n of pixels arranged in a vertical direction in FIG. 10=480. The numbers of the signal lines D1–Dm and the lines E1–Em are 1,920, respectively. The numbers of the signal lines P1–Pn, W1–Wn and R1–Rn are 480, respectively.

Figure 11A:
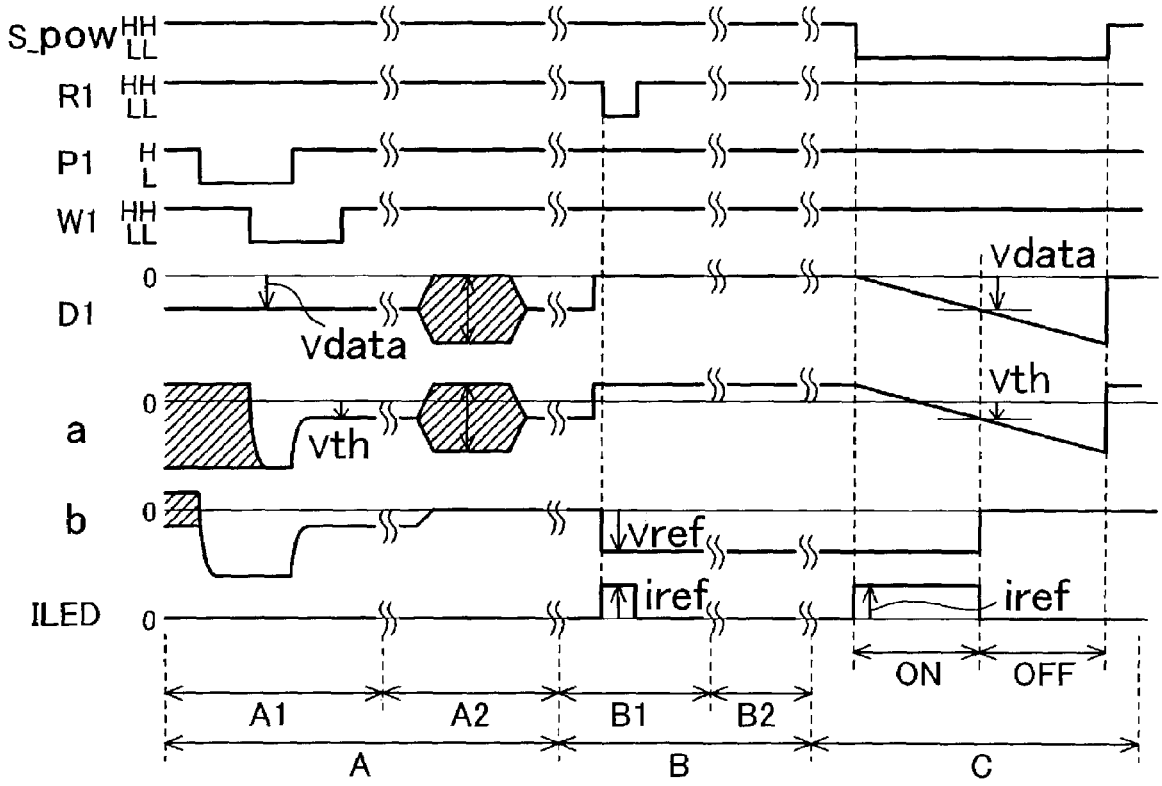
FIG. 11 illustrates a drive voltage waveform, an operating voltage waveform, an operating current waveform, and their timing charts in the third embodiment in accordance with the present invention.
Figure 11B:
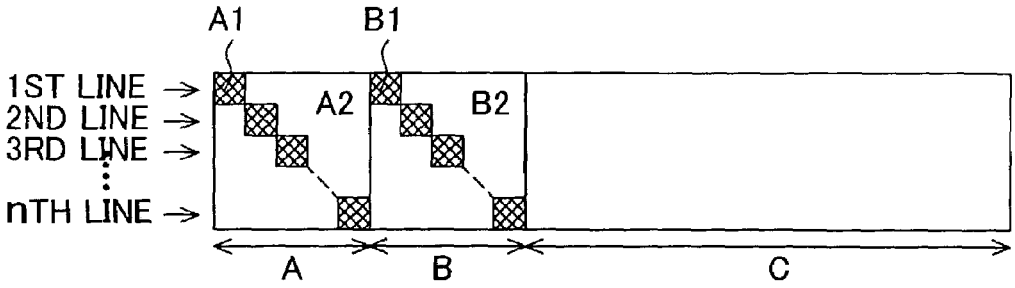

FIG. 11A illustrates a drive voltage waveform, an operating voltage waveform, and an operating current waveform in the third embodiment in accordance with the present invention, and FIG. 11B is a timing chart of the waveforms of FIG. 11A during one frame period.

The abscissa of FIG. 11A represents time, and portions indicated by wavy lines mean there is discontinuity in time.

In FIG. 3A, S_pow, R1, P1, W1 and D1 represent voltages supplied to their corresponding lines on corresponding ones of the ordinates, and "a" and "b" represent voltages appearing at nodes a and b in FIG. 9 on the respective ordinates. ILED indicates a current flowing into the EL element 81 on the ordinate. In FIG. 11A, the more positive values are nearer the top of FIG. 11A. The signals of S_pow, R1, P1 and W1 are binary logical voltages, and the signal of D1 is an analog signal voltage.

In S_pow, R1 and W1, the LL level is a voltage lower than a voltage capable of turning ON TFT 71 and TFT 75–TFT 77, and the HH level is a voltage higher than a voltage capable of turning OFF TFT 71 and TFT 75–TFT 77. In P1, the H level voltage is a voltage low enough to turn OFF TFT 74, the L level voltage is a voltage higher than the H level voltage. The analog voltages on the signal line D1 and at the nodes a, b is illustrated with the reference 0 V taken as the H level voltage. Hatched portions in FIG. 11A indicate they can take plural values, or they are not relevant to operations.

A suffix "1" in R1, P1, W1 and D1 in FIG. 11A indicates that they are signals supplied to the pixel 62 in the first column and the first row, and therefore voltages R, P, W and D for other pixels are followed by numerals indicating rows or columns associated with them.

In the timing chart in FIG. 11B, the ordinate represents line numbers in the display region 61, "mth" indicating that a given pixel 12 is in the mth line from the top of the display region 61, and the abscissa represents time in one frame period.

One frame period is divided into a time A for writing display signals into pixels, a time B for writing a reference current into the pixels, and a time C for the EL elements to emit light and thereby to display an image. Further, the time A is divided into times A1 each of which is used for writing display signals into pixels in a given line and times A2 each of which is used for writing display signals into pixels in lines other than the given line, and the time B is divided into times B1 each of which is used for writing a reference signal into pixels in a given line and times B2 each of which is used for writing the reference current into pixels in lines other than the given line.

During the time A, the times A1 are assigned to successive time positions of the first (at the beginning of the time A), second, third, . . . , nth lines (at the end of the time A), respectively, and the rest of the time A after the times A1 are the times A2. In the similar way, during the time B, the times B1 are assigned to successive time positions of the first (at the beginning of the time B), second, third, . . . , nth lines (at the end of the time B), respectively, and the rest of the time B after the times B1 are the times B2.

During the time A1, TFT 71–TFT 73 and the capacitor 78 of the pixel circuit operate. When the analog voltage signal Vdata, which is a display signal, is supplied to the signal line D1, the voltage Vdata is also supplied to one terminal of the capacitor 78 coupled to the signal line D1. Initially, when the signal line P1 is changed to the L level, the voltage is transferred to the node b via TFT 73. Next, when the signal line W1 is changed to the LL level, TFT 71 is turned ON, and the node a also goes to the L level. Thereafter, when the signal line P1 is changed to the H level, a current flows through TFT 72, and there remains at the nodes a and b, a threshold voltage Vth which is a voltage between the gate and source electrodes of TFT 72 just enough to switch between ON and OFF states between the drain and source electrodes of TFT 72, and therefore the threshold voltage Vth is applied to the other terminal of the capacitor 78. Finally, when the signal line W1 is changed to the HH level, the node a is disconnected from the node b, and thereby the capacitor 78 stores the voltage (Vdata−Vth).

During the time A2, since display signals are being written into the pixels in the lines other than the given line, the signals on the signal lines R1, P1 and W1 are unchanged. At this time, although the voltage on the signal line D1 changes, TFT 71 is in the OFF state, and therefore the voltage (Vdata−Vth) stored in the capacitor 78 is retained.

During the time B, the reference-current source 82 generates a current iref flowing into the reference-current source 82 from the line E1. The current iref can be obtained which is a constant current nearly equal to Vx/Rx, where Vx is a voltage of the power source 87, and Rx is a resistance of the resistor 84, by selecting the voltage of the power supply 87 to be sufficiently high.

The resistor 84 can be fabricated by patterning into a narrow strip a polysilicon film used for source and drain electrodes of thin film transistors, or a metal lead used for a gate electrode of thin film transistors.

During the time B1, TFT 74–TFT 76 and the capacitor 79 of the pixel circuit operate. During the time B1, when TFT 75 and TFT 76 are turned ON by changing the signal lines R1 to the LL level, the constant current iref flows through a path formed of the power supply 86, TFT 76, TFT 74, the line E1 and the reference-current source 82 in the order named. At this time, TFT 74 operates in its saturation region, and there appears between the gate and source electrodes of TFT 74, a voltage Vref necessary for TFT 74 to flow the current iref between its drain and source electrodes, and the voltage Vref is applied to the capacitor 79. Thereafter, when the signal line R1 changes to the HH level, and thereby TFT 75 and TFT 76 are turned OFF, the current flowing through TFT 74 changes to zero, but the voltage Vref is stored in the capacitor 79.

During the time B2, although the current iref is being written into the pixels in the lines other than the given line, since the control signal on the signal line R1 are at the HH level, TFT 75 and TFT 76 retain the OFF state, and therefore the voltage of the capacitor 79 is retained.

As explained above, the voltage Vth is preset in the capacitors 79 of all the pixels in the time B (the preset operation).

During the time C, the signal line S_pow is changed to the LL level, and thereby TFT 77 is turned ON, a current flows through a path formed of the power supply 86, TFT 74, TFT 77, the EL element 81 and the common electrode 89 in the order named, and the EL element 81 emit light. At this time, TFTs 74 in all the pixel circuits generate the constant current iref due to the voltage Vref stored in the capacitor 20, and consequently, the constant currents iref flow through the EL elements 81, and the EL elements 21 emit light of uniform intensity.

On the other hand, the signal line D1 is supplied with a triangular waveform voltage varying from the highest voltage to the lowest voltage of a range where analog voltages of display signals can take. During the time C, the voltage on the signal line D1 decreases gradually with time in a triangular waveform fashion, and therefore the voltage at the node a in the pixel 62 also decreases. When the voltage on the signal line D1 becomes equal to the voltage Vdata having been written into each of the pixels 62 during the time A1, the voltage at the node a becomes equal to the threshold voltage Vth of TFT 72, and thereby TFT 72 changes from OFF to ON, the capacitor 79 is charged through TFT 72, and the voltage at the node b changes to the H level. As a result, TFT 74 is turned OFF which has been flowing the constant current iref therethrough, and the EL element 81 ceases to emit light because the current flowing through TFT 74 becomes zero (the reset operation).

It is necessary to fix the signal line P1 at the H level when the triangular waveform voltage is supplied to the signal line D1, because the threshold voltage Vth of TFT 72 is a voltage with respect to a voltage of its source electrode. That is to say, the H level voltage of the signal line P1 serves as the reference voltage for the triangular waveform voltage.

Finally, the time C is terminated by changing the signal line S_pow to the HH level again, and thereby turning OFF TFT 77.

As explained above, the preset operation has been completed during the time C regardless of display signals, and timing of the reset operation of turning OFF TFT 74 depends upon the analog display signal voltage Vdata. Therefore the ratio in duration between the ON time and the OFF time of the EL element 81 can be varied from 0% to 100% of the time during which the signal line S_pow is at the LL level, based upon the analog voltage Vdata.

The luminance of light emission from the EL element 81 is kept constant by the current iref, and therefore the average luminance of the EL element 82 is proportional to the ratio in duration between the ON time and the OFF time. That is to say, the average luminance of the pixel 62 can be controlled by the analog display signal voltage Vdata.

Consequently, the average luminance of each of the pixels can be controlled to produce various levels according to the analog display voltage signals Vdata, and therefore the third embodiment of the present invention is capable of producing an image containing various gray scale levels.

Further, γ correction can be easily made on a relationship between the analog voltage signals Vdata and the average luminance only by varying the angle of slope of the triangular waveform voltage to be supplied to the signal line D1. Further, a voltage of a waveform increasing with time discontinuously can be used instead of the voltage of a triangular waveform illustrated in FIG. 11A. For example, a voltage of a waveform can be used which increases with time in a staircase fashion.

Further, the light emitting time of the EL element 81 is always continuous within one frame time, and therefore no pseudo contours appear even when moving pictures are displayed.

Further, the number of times when display signals and the reference current are written into each of the pixels 62 during one frame period is two in total, therefore the number of writing times is small, and increasing of resolution is facilitated.

Consequently, the third embodiment of the present invention is capable of providing the EL display which facilitates γ correction, is free from occurrence of pseudo contours in moving pictures, and facilitates increasing of resolution.

The third embodiment of the present invention has been described as composed of p-channel type thin film transistors, but it is apparent that embodiments similar to the third embodiment of the present invention can be realized by using n-channel type thin film transistors as in the case of the relationship between the first and second embodiments of the present invention.

Figure 12:
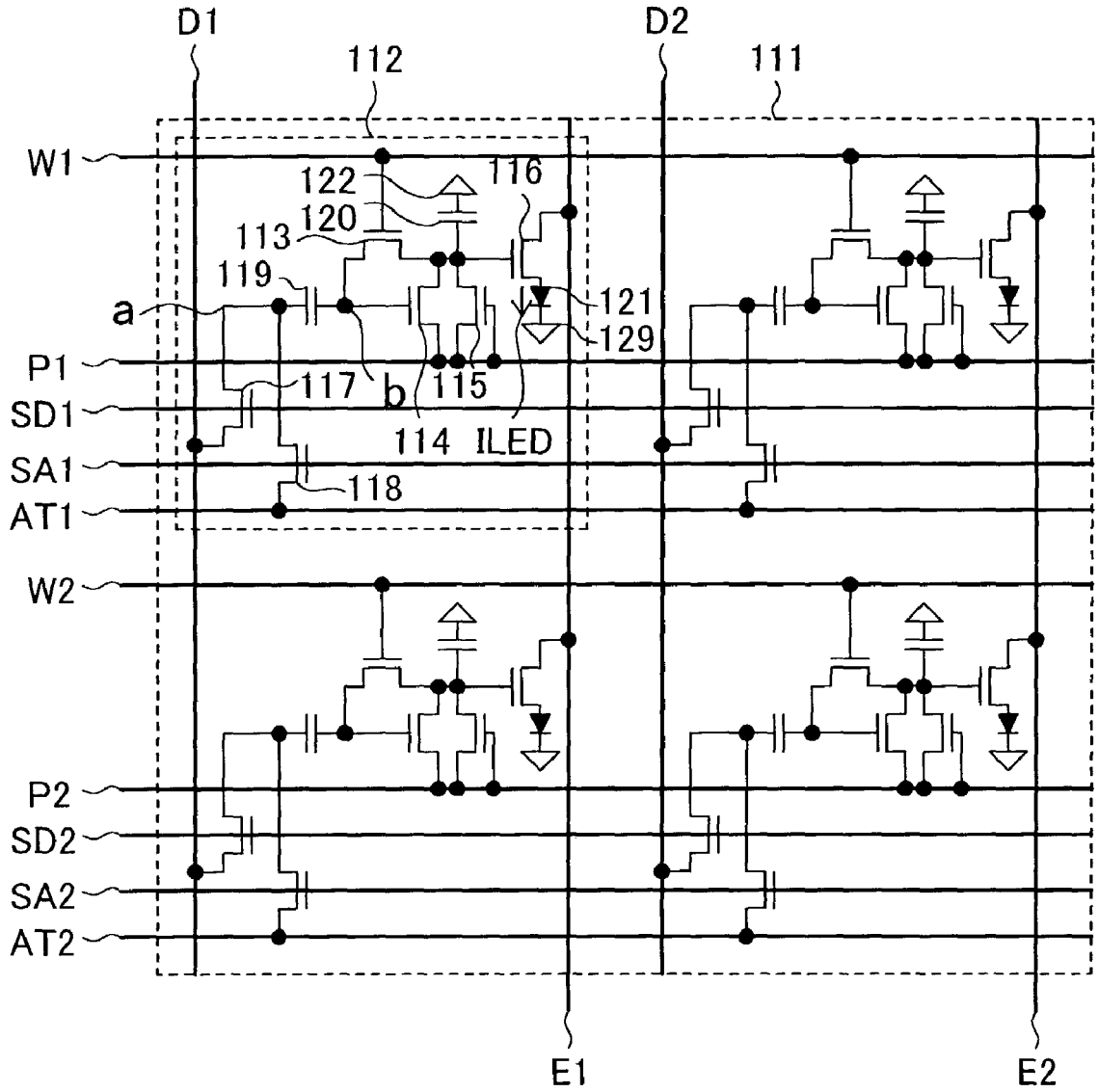
FIG. 12 is a circuit diagram illustrating pixels and their peripheries in a fourth embodiment in accordance with the present invention.

(4) FIG. 12 is a circuit diagram illustrating pixels and their peripheries in a fourth embodiment in accordance with the present invention. The fourth embodiment of the present invention is configured to make it possible to lengthen a time for writing display signals into the pixels. A plurality of pixels 112 are arranged in two dimensions in a display region 111 for displaying an image. The pixel 112 is composed of a pixel circuit formed of TFT 113–TFT 118 and capacitors 119, 120, and an EL element 121. A cathode of the EL element 121 is connected to a common electrode 129. All of TFT 113–TFT 118 are n-channel type thin film transistors. Arranged in a matrix configuration in the display region 111 are signal lines D1, D2 for transmitting analog voltage signals containing display signals, lines E1, E2 for supplying a current to be flowed into the EL element 121, signal lines W1, W2, P1, P2, SD1, SD2, SA1 and SA2 for controlling the pixel circuit of the pixel 112, and signal lines AT1, AT2 for supplying a triangular waveform voltage signal. One terminal of the capacitor 120 is connected to an electrode 122. The electrode 122 is formed by a line grounded outside of the pixel circuit, is connected to the common electrode 129, or is connected to the line E1.

TFT 116 serves as switching means, and controls the supply and cutoff of a current from the line E1 to the EL element 121. The capacitor 120 stores an ON or OFF state of TFT 116 serving as switching means by retaining a gate voltage of TFT 116.

TFT 115 serves as preset means, and presets a voltage at the capacitor 120 when a positive pulse is input to the signal line P1. TFT 114 serves as reset means, and controls resetting of the voltage of the capacitor 120 depending upon whether the gate voltage of TFT 114 exceeds its threshold voltage or not. TFT 113 serves as means for canceling the threshold voltage of TFT 114. The capacitor 119 is storage means for storing a voltage difference between an analog display voltage signal on the signal line D1 and the threshold voltage of TFT 114. TFT 117 is a selector switch for selecting an analog display voltage signal on the signal line D1 and supplying it to the capacitor 119. TFT 118 is a selector switch for selecting a triangular waveform voltage on the signal line AT1 and supplying it to the capacitor 119.

Figure 13:
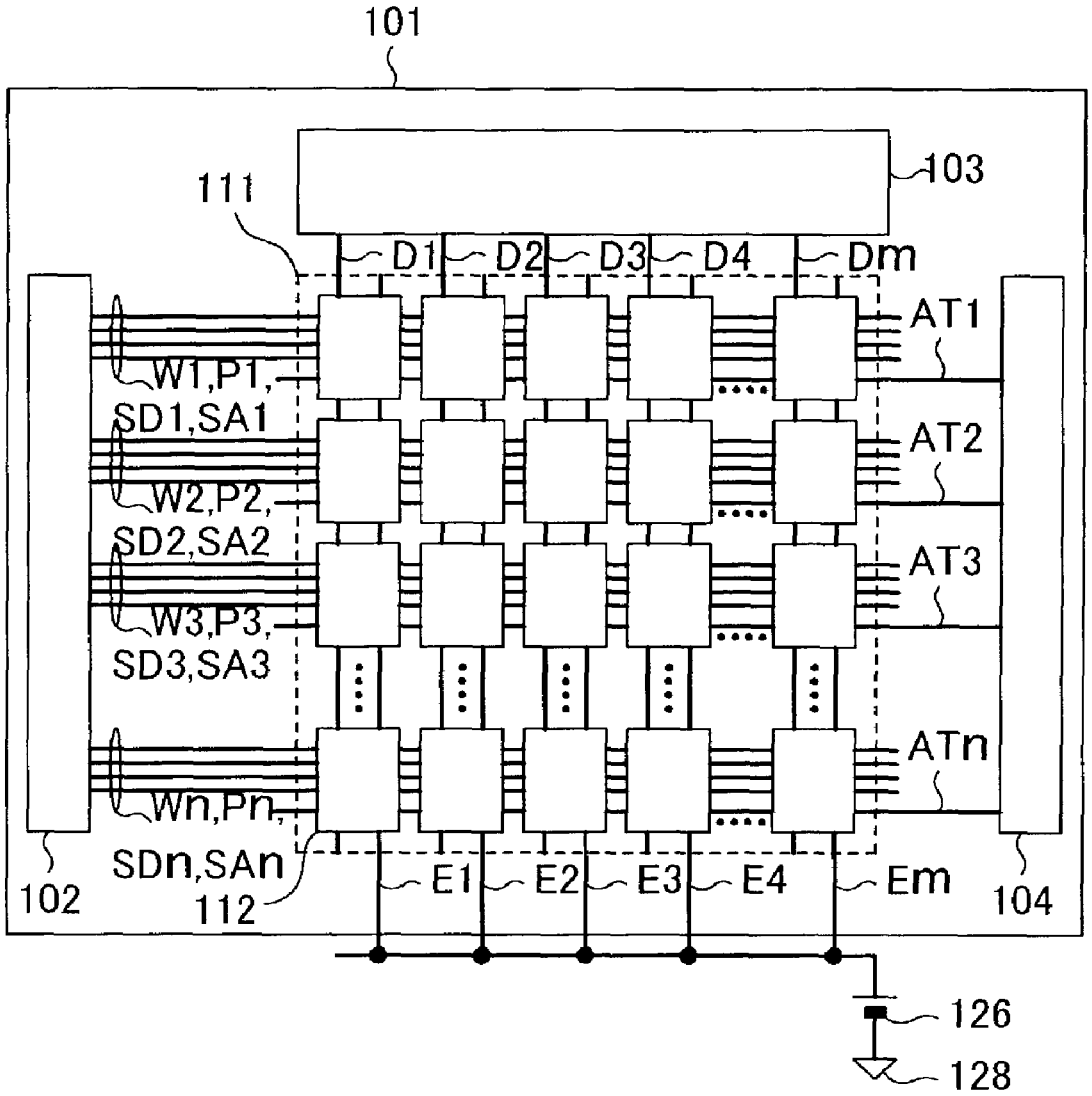
FIG. 13 is an illustration of a configuration of a fourth embodiment in accordance with the present invention.

FIG. 13 illustrates a configuration of the fourth embodiment in accordance with the present invention. The display region 111 is disposed on a surface of a glass substrate 101, and a plurality of pixels 112 are fabricated in the display region 111. Disposed on the surface of the glass substrate 101 are the signal lines W1–Wn, P1–Pn, SD1–SDn, SA1–SAn, AT1–ATn, and D1–Dm, lines E1–Em, a scanning circuit 2 for generating control signals for the signal lines W1–Wn, P1–Pn, SD1–SDn and SA1–SAn, a signal circuit 103 for generating signals for the signal lines D1–Dm, and a triangular waveform generator circuit 104 for generating a waveform voltage for the signal lines AT1–ATn.

The scanning circuit 102, the signal circuit 103 and the triangular waveform generator circuit 104 can be formed by fabricating thin film transistors on the glass substrate 101, or can be formed by attaching semiconductor LSIs on the glass substrate 101. Capabilities of the scanning circuit 102 for supplying signals to the signal lines W1–Wn, P1–Pn, SD1–SDn, SA1–San and the triangular waveform generator circuit 104 for supplying the triangular waveform voltage to the signal lines AT1–ATn are improved by arranging both the scanning circuits 102 and the triangular waveform generator circuit 104 on opposite sides of the display region 111. The signal circuit 103 may be disposed either above or below the display region 111 in FIG. 13.

A power supply 126 external to the glass substrate 101 is connected to a grounding electrode 128 and all of the lines E1–Em. The lines E1–Em are connected together with each other on the surface of the glass substrate 101 or outside of the glass substrate 101. When the lines E1–Em are connected together on the surface of the glass substrate 101, they may be formed as a single mesh-like electrode by forming many lines short-circuiting adjacent ones of the lines E1–Em.

Although not shown in FIG. 13, the common electrode 129 is formed to cover the display region 111, and is connected to the EL elements 121 of all the pixels 112. The common electrode 129 is electrically connected to the grounding electrode 128.

Light emitted from the EL element 121 of the pixel 112 passes through the glass substrate 101 toward its rear surface, and a display image is viewed from the reverse side of paper of FIG. 13. If the common electrode 129 is made of transparent material, the display image can also be viewed even from the front side of FIG. 13. An organic EL diode can be used as the EL element 121. If red, green, and blue light emitting materials are used for corresponding ones of the EL elements 121, a color display can be produced.

Incidentally, the display region 111 is illustrated as formed of only four (2×2) pixels 112 in FIG. 12, but the display region 111 intended for practical use has a larger number of pixels. In the case of resolution of color VGA (640 pixels×3 colors (red, green and blue)×480 pixels), the number m of pixels arranged in a horizontal direction in FIG. 13=1,920, and the number n of pixels arranged in a vertical direction in FIG. 13=480. The numbers of the signal lines D1–Dm and the lines E1–Em are 1,920, respectively. The numbers of the signal lines W1–Wn, P1–Pn, SD1–SDn, SA1–SAn, and AT1–ATn are 480, respectively.

Figure 14A:
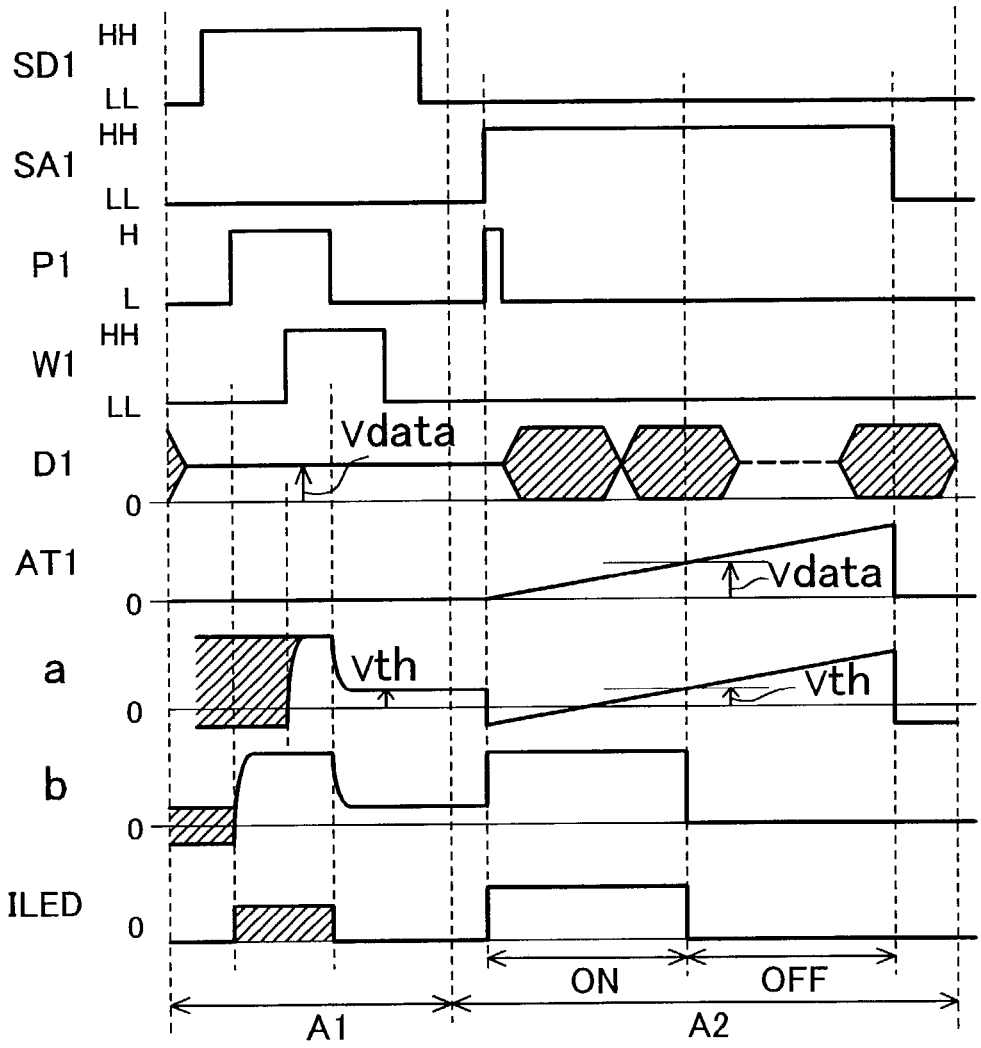
FIG. 14 illustrates a drive voltage waveform, an operating voltage waveform, an operating current waveform, and their timing charts in the fourth embodiment in accordance with the present invention.
Figure 14B:
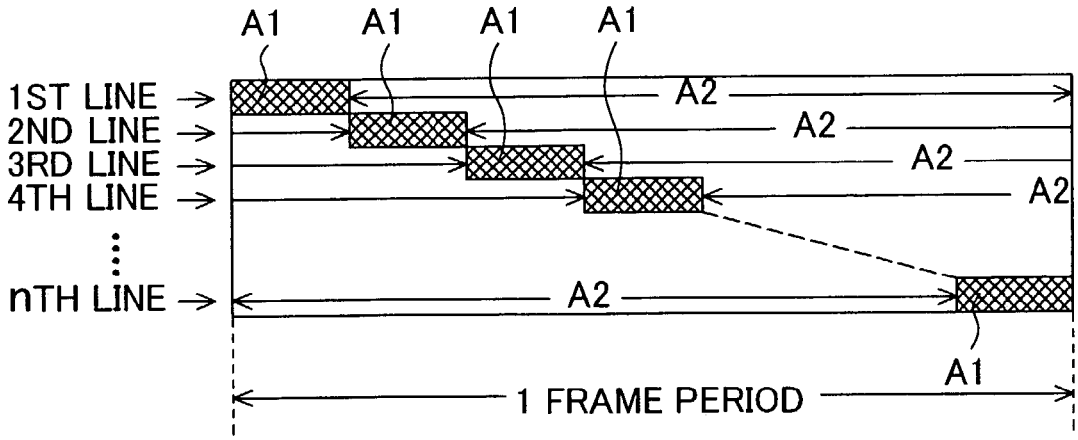

FIG. 14A illustrates a drive voltage waveform, an operating voltage waveform, and an operating current waveform in the fourth embodiment in accordance with the present invention, and FIG. 14B is a timing chart of the waveforms of FIG. 14A during one frame period.

The abscissa of FIG. 14A represents time. In FIG. 14A, SD1, SA1, P1, W1, D1 and AT1 represent voltages supplied to their corresponding lines on corresponding ones of the ordinates, and "aa" and "bb" represent voltages appearing at nodes a and b in FIG. 12 on the respective ordinates. ILED indicates a current flowing into the EL element 121 on the ordinate. In FIG. 14A, the more positive values are nearer the top of FIG. 14A. The signals of SD1, SA1, P1 and W1 are binary logical voltages, and the signals of AT1 and D1 are analog signal voltage.

In SD1, SA1 and W1, the HH level is a voltage at which TFT 117, TFT 118 and TFT 113 are turned ON, respectively, and the LL level is a voltage at which TFT 117, TFT 118 and TFT 113 are turned OFF, respectively. In P1, the H level is a voltage sufficient for turning ON TFT 116, and the L level is a voltage sufficient for turning OFF TFT 116.

Analog voltages on the signal lines D1, AT1 and at the nodes a, b are illustrated with the reference voltage 0 volt taken as the L level voltage. Hatched portions in FIG. 14A indicate that they can take plural values, or that they are not relevant to operations.

A suffix "1" in W1, P1, SD1, SA1, AT1 and D1 in FIG. 14A indicates that they are signals supplied to the pixel 112 in the first column and the first row, and therefore voltages W, P, SD, SA, AT and D for other pixels are followed by numerals indicating rows or columns associated with them.

In the timing chart in FIG. 14B, the ordinate represents line numbers in the display region 111, "mth" indicating that a given pixel 112 is in the mth line from the top of the display region 111, and the abscissa represents time in one frame period.

One frame period is divided into times A1 each of which is used for writing display signals into pixels in a given line and times A2 each of which is used for lighting the pixels in the given line.

During one frame period, the times A1 are assigned to successive time positions of the first (at the beginning of the frame period), second, third, . . . , nth lines (at the end of the frame period), respectively, and the time A2 is a time interval from the end of the time A1 in a given row in a given frame period to the beginning of the time A1 in the given row in a frame period succeeding the given frame period. In short, timings of adjacent rows are shifted by the time A1 from each other.

In the time A1, when the analog display voltage signal Vdata is supplied to the signal line D1 by changing the signal line SD1 to the HH level, the voltage Vdata is also supplied to one terminal of the capacitor 119 via TFT 117. Then, when the signal line P1 is changed to the H level, the H level voltage is supplied to the node b via TFT 115. Next, when the signal line W1 is changed to the HH level, TFT 113 is turned ON, and the node a changes to the H level. Thereafter, when the signal line P1 is changed to the L level, a current flows through TFT 114, there remains at the nodes a and b, a threshold voltage Vth which is a voltage between the gate and source electrodes of TFT 14 just enough to switch between ON and OFF states between the drain and source electrodes of TFT 114, and therefore the threshold voltage Vth is applied to the other terminal of the capacitor 119. Thereafter, when the signal line W1 is changed to the LL level, the node a is disconnected from the node b, and thereby the capacitor 119 stores the voltage difference (Vdata−Vth), where Vdata is the analog display voltage signal, and Vth is the threshold voltage of TFT 114. Finally, TFT 117 is turned OFF by changing the signal line SD1 to the LL level.

In this case, although a current flows through the EL element 121 during a time when the signal line P1 is at the H level, and thereby the EL element emits light, this light emission can be ignored because the time during which the signal line P1 is at the H level is shorter by far than one frame period.

During the time A2, since display signals are being written into the pixels in the lines other than the given line, the signals on the signal lines W1, P1 and SD1 are unchanged. At this time, although the voltage on the signal line D1 changes, TFT 113 and TFT 117 are in the OFF state, and therefore the voltage (Vdata−Vth) stored in the capacitor 119 is retained. Further, the pixel 112 performs lighting operation during the time A2. When the H level pulse is supplied to the signal line P1 at the beginning of the time A2, the H level voltage is applied to the capacitor 120 via TFT 115, and TFT 116 is turned ON. Since the capacitor 120 stores the H level voltage even after the signal line P1 has changed to the L level, TFT 116 retains the ON state, and thereby a current flows into the EL element 121 from the line E1, resulting in light emission from the EL element 121 (preset operation).

Further, when the signal line SA1 is changed to the H level simultaneously with supplying of the H level pulse to the signal line P1, TFT 118 is turned ON, and the capacitor 119 is supplied with a voltage on the signal line AT1. The signal line AT1 is supplied with a triangular waveform voltage increasing uniformly from the lowest voltage to the highest voltage of a range where analog voltages of display signals can take.

During the time A2, the voltage on the signal line AT1 increases gradually with time in a triangular waveform fashion, and therefore the voltage at the node a in the pixel 112 also increases. When the voltage on the signal line AT1 becomes equal to the voltage Vdata having been written into each of the pixels 112 during the time A1, the voltage at the node a becomes just equal to the threshold voltage Vth of TFT 114, and thereby TFT 114 changes from OFF to ON, the charge in the capacitor 120 is discharged through TFT 114, and the voltage at the node b changes to the L level. As a result, TFT 116 is turned OFF, the current flowing through TFT 116 becomes zero, and the EL element 112 ceases to emit light (reset operation).

It is necessary to fix the signal line P1 at the L level when the triangular waveform voltage is supplied to the signal line AT1, because the threshold voltage Vth of TFT 114 is a voltage with respect to a voltage of its source electrode. That is to say, the L level voltage of the signal line P1 serves as the reference voltage for the triangular waveform voltage.

Finally, the time A2 is terminated by changing the signal line SA1 to the LL level again.

As explained above, the preset operation of turning ON TFT 16 in the time C is performed at the beginning of the time A2 regardless of display signals, and timing of the reset operation depends upon the analog display signal voltage Vdata. Therefore the ratio in duration between the lighting time and the extinguishing time of the EL element 121 can be varied from 0% to 100% based upon the analog display voltage signal Vdata.

By supplying a current from the power supply 126 such that the luminance of light emission from the EL element 121 is approximately constant in the light-emitting state of the EL element 21, the average luminance of the EL element 112 can be controlled by this ratio between the ON time and the OFF time, that is, the analog display signal voltage Vdata.

The average luminance of each of the pixels can be controlled to produce various levels according to the analog display voltage signals Vdata, and consequently, the fourth embodiment of the present invention is capable of producing an image containing various gray scale levels.

Further, γ correction can be easily made on a relationship between the analog voltage signals Vdata and the average luminance only by varying the angle of slope of the triangular waveform voltages to be supplied to the signal lines AT1–ATm. Further, a voltage of a waveform increasing with time discontinuously can be used instead of the voltage of a triangular waveform illustrated in FIG. 14A. For example, a voltage of a waveform can be used which increases with time in a staircase fashion.

Further, the light emitting time of the EL element 121 is always continuous within one frame time, and therefore no pseudo contours appear even when moving pictures are displayed.

Further, the number of times when display signals are written into each of the pixels 112 during one frame period is only once, therefore the number of writing times is small, and moreover, times for writing display signals into each of the pixels 112 can be allotted over the entire frame period, and therefore each of the times for writing can be increased, and consequently, increasing of resolution is facilitated.

Consequently, the fourth embodiment of the present invention is capable of providing the EL display which facilitates γ correction, is free from occurrence of pseudo contours in moving pictures, and facilitates increasing of resolution.

As a first modification of the fourth embodiment of the present invention, TFT 116 can be formed of a p-channel type thin film transistor. In this case, TFT 116 is OFF when its gate voltage is at the H level, and TFT 116 is ON when its gate voltage is at the L level. Therefore TFT 116 is turned OFF by the preset operation, and the state of TFT 116 is inverted into the ON state by the reset operation.

That is to say, the lighting time and extinguishing time of the EL element 112 during the time A2 are interchanged. In this modification also, the average luminance of the EL element 112 can be controlled by this ratio between the ON time and the OFF time, that is, the analog display signal voltage Vdata, and therefore this modification provides the same advantages as in the case of the fourth embodiment.

Further, the fourth embodiment of the present invention can employ structures similar to those of the second and fourth modifications of the first embodiment of the present invention.

The image display apparatuses of the embodiments and their modifications of the present invention make it possible to form their pixel circuits by using thin film transistors of an n-channel type or p-channel type only, and consequently, provide the advantage of reducing production cost compared with conventional image display apparatuses requiring thin film transistors of both n- and p-channel types.

The image display apparatuses of the embodiments and their modifications of the present invention make it possible to prevent occurrence of pseudo contours, facilitate gamma correction, and facilitate increasing of resolution when they are employed in portable telephones, television sets, PDAs (Portable Digital Assistants), notebook personal computers, or monitors.

ADVANTAGES OF THE PRESENT INVENTION

The present invention has reduced to one or two the number of times when display signals are written into each of the pixels during one frame period, and facilitated increasing of resolution.

Further, γ correction can be easily made on a relationship between the analog voltage signals Vdata and the average luminance only by varying the angle of slope of the triangular waveform voltage to be supplied to the signal line.

Further, the light emitting time of the EL element is always continuous within one frame time, and therefore no pseudo contours appear even when moving pictures are displayed.

What is claimed is:

1. An image display apparatus comprising:

a plurality of pixels disposed on a substrate, and a plurality of signal lines disposed on said substrate for inputting an analog display voltage signal into each of said plurality of pixels, wherein:

each of said plurality of pixels is provided with a light emitting element with light intensity thereof varying with a current therethrough, and a pixel circuit for driving said light emitting element, and said pixel circuit is provided with:

switch means for switching between two states of supply and cutoff of a current to said light emitting element, preset means for presetting said switch means at one of said two states independently of said analog display voltage signal, and reset means for reversing said one of said two states of said switch means based upon said analog display voltage signal wherein said reset means is provided with storage means for storing said analog display voltage signal, is supplied with a triangular waveform voltage signal, is provided with at least one thin film transistor, supplies a voltage difference between said analog display voltage signal stored in said storage means and said triangular waveform voltage signal to a gate electrode of said at least one thin film transistor, and determines timing for resetting said switch means by comparing said voltage difference with a threshold voltage of said at least one thin film transistor.

2. An image display apparatus according to claim 1, wherein said storage means is formed of a capacitor.

3. An image display apparatus according to claim 1, wherein said reset means is provided with a capacitor serving as said storage means for storing said analog display voltage signal, and is provided with at least one thin film transistor, one electrode of said capacitor is connected to a gate electrode of said at least one thin film transistor, and another electrode of said capacitor is connected to a corresponding one of said plurality of signal lines, and said corresponding one of said plurality of signal lines is supplied with said analog display voltage signal and a triangular waveform voltage signal by time-division multiplexing.

4. An image display apparatus according to claim 1, further comprising a triangular waveform supply line for supplying a triangular waveform voltage signal, wherein said reset means is provided with a capacitor serving as storage means for storing said analog display voltage signal, and is provided with selector means for selecting one of said analog display voltage signal supplied to a corresponding one of said plurality of signal lines and said triangular waveform voltage signal supplied to said triangular waveform supply line and for supplying said selected one of said analog display voltage signal and said triangular waveform voltage signal to said capacitor.

5. An image display apparatus according to claim 4, wherein said selector means is formed of two thin film transistors connected to said triangular waveform supply line and said corresponding one of said plurality of signal lines, respectively.

6. An image display apparatus according to claim 1, wherein said reset means is provided with a first thin film transistor for comparing said triangular waveform voltage signal with said analog display voltage signal stored in said storage means, and is provided with threshold voltage canceling means for canceling a threshold voltage of said first thin film transistor.

7. An image display apparatus according to claim 6, wherein said threshold voltage canceling means is formed of a second thin film transistor for controlling closing and opening one of a path between a gate electrode and a source electrode of said first thin film transistor and a path between said gate electrode and a drain electrode of said first thin film transistor.

8. An image display apparatus according to claim 1, wherein said switch means is formed of at least one thin film transistor for controlling the supply and cutoff of said current to said light emitting element and a capacitor for retaining a gate electrode voltage of said at least one thin film transistor, and said preset means is formed of a preset signal line for transmitting a preset signal and at least one thin film transistor for charging or discharging said capacitor.

9. An image display apparatus according to claim 1, wherein said reset means is provided with a capacitor serving as storage means for storing said analog display voltage signal, and is provided with at least one thin film transistor, and a gate electrode of said at least one thin film transistor is connected to said capacitor, and a source electrode of said at least one thin film transistor is connected to a reference-voltage line for supplying a fixed voltage.

10. An image display apparatus according to claim 8, wherein said reference-voltage line and said preset signal line is formed of a same line.

11. An image display apparatus according to claim 9, wherein said reference-voltage line and said preset signal line is formed of a same line.

12. An image display apparatus according to claim 1, wherein said pixel circuit is provided with a constant-current circuit for keeping constant the current to said light emitting element.

13. An image display apparatus according to claim 1, wherein said pixel circuit is formed of thin film transistors.

14. An image display apparatus according to claim 1, wherein said pixel circuit is formed of thin film transistors of only one of n-channel end p-channel types.

15. An image display apparatus according to claim 1, wherein said switch means comprises at least one thin film transistor for controlling the supply and cutoff of said current to said light emitting element and a capacitor for retaining a gate electrode voltage of said at least one thin film transistor.

* * * * *